US009502040B2

(12) United States Patent
Kuntz et al.

(10) Patent No.: US 9,502,040 B2
(45) Date of Patent: Nov. 22, 2016

(54) ENCODING AND DECODING OF SLOT POSITIONS OF EVENTS IN AN AUDIO SIGNAL FRAME

(71) Applicant: Fraunhofer-Gesellschaft zur Foerderung der angewandten Forschung e.V., Munich (DE)

(72) Inventors: Achim Kuntz, Hemhofen (DE); Sascha Disch, Fuerth (DE); Tom Baeckstroem, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 326 days.

(21) Appl. No.: 13/944,766

(22) Filed: Jul. 17, 2013

(65) Prior Publication Data

US 2013/0304480 A1 Nov. 14, 2013

Related U.S. Application Data

(63) Continuation of application No. PCT/EP2012/050613, filed on Jan. 17, 2012.
(Continued)

(30) Foreign Application Priority Data

Jul. 6, 2011 (EP) ..... 11172791

(51) Int. Cl.
*G10L 19/00* (2013.01)
*G10L 21/00* (2013.01)
(Continued)

(52) U.S. Cl.
CPC ..... *G10L 19/00* (2013.01); *G10L 19/167* (2013.01); *G10L 19/24* (2013.01); *G10L 19/008* (2013.01)

(58) Field of Classification Search
USPC ..... 704/500–504
See application file for complete search history.

(56) References Cited

U.S. PATENT DOCUMENTS 5,974,379 A * 10/1999 Hatanaka ..... G10L 19/025 704/224
6,424,938 B1 7/2002 Johansson et al.
(Continued)

FOREIGN PATENT DOCUMENTS

CA 2664466 A1 4/2008
CN 101243490 A 8/2008
(Continued)

OTHER PUBLICATIONS

"Information technology—MPEG audio technologies", ISO/IEC 23003-1:2007, Information technology—MPEG audio technologies —Part 1: MPEG Surround.
(Continued)

*Primary Examiner* — Edgar Guerra-Erazo
(74) *Attorney, Agent, or Firm* — Perkins Coie LLP; Michael A. Glenn

(57) ABSTRACT

An apparatus for decoding, an apparatus for encoding, a method for decoding and a method for encoding positions of slots having events in an audio signal frame and respective computer programs and encoded signals, wherein the apparatus for decoding has: an analyzing unit for analyzing a frame slots number indicating the total of slots of the audio signal frame, an event slots number indicating the number of slots having the events of the audio signal frame, and an event state number, and a generating unit for generating an indication of a plurality of positions of slots having the events in the audio signal frame using the frame slots number, the event slots number and the event state number.

17 Claims, 22 Drawing Sheets

Related U.S. Application Data

(60) Provisional application No. 61/433,803, filed on Jan. 18, 2011.

(51) Int. Cl.

| | |
|---|---|
| ***G10L 19/16*** | (2013.01) |
| ***G10L 19/24*** | (2013.01) |
| *G10L 19/008* | (2013.01) |

(56) References Cited

U.S. PATENT DOCUMENTS

| | | | | |
|---|---|---|---|---|
| 7,353,169 | B1 * | 4/2008 | Goodwin | G10L 19/025 704/224 |
| 7,519,538 | B2 | 4/2009 | Villemoes et al. | |
| 7,783,494 | B2 | 8/2010 | Pang et al. | |
| 7,974,713 | B2 * | 7/2011 | Disch | H04S 3/008 341/60 |
| 8,116,459 | B2 * | 2/2012 | Disch | H04S 3/002 381/10 |
| 8,184,817 | B2 * | 5/2012 | Takagi | G10L 19/008 381/20 |
| 8,463,614 | B2 * | 6/2013 | Zhang | G10L 19/025 704/224 |
| 8,644,972 | B2 * | 2/2014 | Disch | H04S 3/008 381/23 |
| 2004/0138886 | A1 * | 7/2004 | Absar | G10L 19/025 704/240 |
| 2004/0181403 | A1 * | 9/2004 | Hsu | G10L 19/025 704/230 |
| 2005/0007262 | A1 * | 1/2005 | Craven | G11B 20/00992 341/50 |
| 2005/0177360 | A1 | 8/2005 | Schuijers et al. | |
| 2007/0081597 | A1 * | 4/2007 | Disch | H04S 3/008 375/242 |
| 2007/0140499 | A1 * | 6/2007 | Davis | G10L 19/008 381/23 |
| 2007/0201514 | A1 | 8/2007 | Pang et al. | |
| 2007/0236858 | A1 * | 10/2007 | Disch | H04S 3/002 361/272 |
| 2009/0326959 | A1 * | 12/2009 | Herre | H04S 5/00 704/500 |
| 2011/0106545 | A1 * | 5/2011 | Disch | H04S 3/008 704/500 |
| 2012/0207307 | A1 * | 8/2012 | Engdegard | G10L 19/008 381/3 |

FOREIGN PATENT DOCUMENTS

| | | | |
|---|---|---|---|
| CN | 101529503 | A | 9/2009 |
| CN | 101784976 | A | 7/2010 |
| EP | 1396843 | A1 | 3/2004 |
| JP | 2009506371 | A | 2/2009 |
| RU | 2251750 | C2 | 5/2005 |
| RU | 2325046 | | 5/2008 |
| WO | 2007027050 | A1 | 3/2007 |
| WO | 2009033147 | A2 | 3/2009 |

OTHER PUBLICATIONS

"Information technology—MPEG audio technologies", ISO/IEC 23003-1:2007, Information technology—MPEG audio technologies—Part 1: MPEG Surround.

Breebaart, et al., "High-Quality Parametric Spatial Audio Coding at Low Bit Rates", Audio Engineering Society Convention Paper, 116th Convention, Berlin, Germany, May 2004, 13 pages.

Disch, et al., "Finalization of CE Proposal on Improved Applause Coding in USAC", ISO/IEC JTC1/SC29/WG11, MPEG2011/M19311, Daegu, Korea, Jan. 2011, Jan. 19, 2011, pp. 1-18.

Engdegard, et al., "Synthetic ambience in parametric stereo coding", 116th AES Convention, Berlin, DE; XP002347433, May 2004, Total of 12 pages.

Herre, et al., "MPEG Surround—The ISO/MPEG Standard for Efficient and Compatible Multichannel Audio Coding", J. Audio Eng. Soc., vol. 56, No. 11, Nov. 2008, 932-955.

Pulkki, et al., "Spatial Sound Reproduction with Directional Audio Coding*", Laboratory of Acoustics and Audio Signal Processing, Helsinki University of Technology, FI-02015 TKK, Finland; J. Audio Eng. Soc., vol. 55, No. 6, Jun. 2007.

* cited by examiner

```
s =bsTsdCodedPos;
p =bsTsdNumTrSlots+1;
N =numSlots

for (k=0; k<N; k++)
{
    TsdSepData[k]=0;
}

for (k=N-1; k>=0; k--)
{
    if (p > k) {
        for (;k>=0; k--)
            TsdSepData[k]=1;
        break;
    }
    c = k-p+1;
    for (h=2; h<=p; h++) {
        c *= k - p + h;
        c /= h;
    }
    if (s >= (int)c) { /* c is long long for up to 32 slots */
        s -= c;
        TsdSepData[k]=1;
        p--;
        if (p == 0)
            break;
        }
}
```

FIG 11

```
p_s = 0;
for (k=tsdPosLen-1; k>=0; k--){
    slots = tsdPos[k];
    if (k >= slots) {
        break;
    }
    c = 1; /* c is long long for up to 32 slots */
    for (h=1; h<=(k+1); h++) {
        c *= slots-k-1 + h;
        c /= h;
    }
    p_s += c;
}
bsTsdCodedPos = p_s;
```

| syntax | No. of bits | mnemonic |
|---|---|---|
| Mps212Data(indepFlag) | | |
| { | | |
| FrameingInfo(); | | |
| if (indepFlag) { | | |
| bsIndependencyFlag=1; | | |
| } else { | | |
| **bsIndependencyFlag;** | **1** | **uimsbf** |
| } | | |
| OttData(); | | |
| SmgData(); | | |
| TempShapeData(); | | |
| if (bsTsdEnable==1) { | | |
| TsdData(); | | |
| } | | |
| } | | |

| syntax | No. of bits | mnemonic |
|---|---|---|
| TsdData() | | |
| { | | |
| **bsTsdNumTrSlots;** | **nBitsTrSlots** | **uimsbf** note 1 |
| TsdSepData=TsdTrPos_dec(**bsTsdCodedPos**); | **nBitsTsdCW** | **vlclbf** note 2, 3 |
| for (ts=0; ts<numSlots; ts++) { | | |
| if (TsdSepData[ts]==1) { | | |
| **bsTsdTrPhaseData[ts]** | **3** | **uimsbf** |
| } else { | | |
| bsTsdTrPhaseData[ts]=0: | | |
| } | | |
| } | | |
| } | | |

note 1: nBitsTrSlots depends on the frame length as defined in Table 98.
note 2: nBitTsdCW is calculated according to the rule described in 7.11.2.4.
note 3: TsdTrPos_dec() is defined in 7.11.2.4.

FIG 17

| numSlots | nBitsTrSlots |
|---|---|
| numSlots ≤ 6 | 1 |
| 6 < numSlots ≤ 12 | 2 |
| 12 < numSlots ≤ 24 | 3 |
| 24 < numSlots ≤ 48 | 4 |
| 48 < numSlots | 5 |

FIG 18

| bsTempShapeConfig | Meaning |
|---|---|
| 0 | do not apply temporal shaping |
| 1 | apply STP |
| 2 | apply GES |
| 3 | apply TSD |

FIG 19

| syntax | No. of bits | mnemonic |
|---|---|---|
| TempShapeData() | | |
| { | | |
| bsTsdEnable = 0; | | |
| if (bsTempShapeConfig == 3) { | | |
| **bsTsdEnable**; | 1 | **uimsbf** |
| }else if ( (bsTempShapeConfig == 1) \|\| (bsTempShapeConfig == 2) ) { | | |
| **bsTempShapeEnable**; | 1 | **uimsbf** |
| if (bsTempShapeEnable) { | | |
| for (ch=0; ch<numTempShapeChan; ch++) { | | note 1 |
| **bsTempShapeEnableChannel**[ch]; | 1 | **uimsbf** |
| } | | |
| if (bsTempShapeConfig == 2) { | | |
| EnvelopeReshapeHuff(bsTempShapeEnableChannel); | | |
| } | | |
| } | | |
| } | | |
| } | | |
| note 1: numTempShapeChan is 2 as defined 6.2.13.2 | | |

FIG 20

| syntax | No. of bits | mnemonic |
|---|---|---|
| EcData(dataType, paramIdx, startBand, stopBand) | | note 1 |
| { | | |
| dataSets = 0; | | |
| for (ps=0; ps<numParamSets; ps++) { | | note 2 |
| **bsXXXdataMode**[paramIdx][ps]; | **2** | **uimsbf** |
| if (bsXXXdataMode[paramIdx][ps] == 3) { | | |
| dataSets++; | | |
| } | | |
| } | | |
| setIdx = 0; | | |
| while (setIdx < dataSets) { | | |
| **bsDataPairXXX**[paramIdx][setIdx]; | **1** | **uimsbf** |
| **bsQuantCoarseXXX**[paramIdx][setIdx]; | **1** | **uimsbf** |
| **bsFreqResStrideXXX**[paramIdx][setIdx]; | **2** | **uimsbf** |
| dataBands = (stopBand-startBand-1)/pbStride+1; | | note 3 |
| EcDataPair(dataType, paramIdx, setIdx, dataBands, bsDataPairXXX[paramIdx][setIdx] , bsQuantCoarseXXX[paramIdx][setIdx]); | | |
| if (bsDataPairXXX[paramIdx][setIdx]) { | | |
| bsQuantCoarseXXX[paramIdx][setIdx+1] = bsQuantCoarseXXX[paramIdx][setIdx]; | | |
| bsFreqResStrideXXX[paramIdx][setIdx+1] = bsFreqResStrideXXX[paramIdx][setIdx]; | | |
| } | | |
| setIdx += bsDataPairXXX[paramIdx][setIdx]+1; | | |
| } | | |
| startBandXXX[paramIdx] = startBand; | | |
| stopBandXXX[paramIdx] = stopBand; | | |
| } | | |

note 1: XXX is to be replaced by the value of dataType (CLD, ICC, IPD).
note 2: numParamSets is defined by numParamSets = bsNumParamSets + 1.
note 3: pbStride is defined in ISO/IEC 23003-1:2007, Table 70 and depends on bsFreqResStride[][]. Furthermore the division shall be interpreted as ANSI C integer division.

FIG 22

ENCODING AND DECODING OF SLOT POSITIONS OF EVENTS IN AN AUDIO SIGNAL FRAME

CROSS-REFERENCE TO RELATED APPLICATIONS

This application is a continuation of copending International Application No. PCT/EP2012/050613, filed on Jan. 17, 2012, which is incorporated herein by reference in its entirety, and additionally claims priority from U.S. Provisional Application No. 61/433,803, filed Jan. 18, 2011, and European Application No. 11172791.3, filed Jul. 6, 2011, which are also incorporated herein by reference in their entirety.

BACKGROUND OF THE INVENTION

The present invention relates to the field of audio processing and audio coding, in particular to encoding and decoding slot positions of events in an audio signal frame.

Audio processing and/or coding has advanced in many ways. In particular, spatial audio applications have become more and more important. Audio signal processing is often used to decorrelate or render signals. Moreover, decorrelation and rendering of signals is employed in the process of mono-to-stereo-upmix, mono/stereo to multi-channel upmix, artificial reverberation, stereo widening or user interactive mixing/rendering.

Several audio signal processing systems employ decorrelators. An important example is the application of decorrelating signals in parametric spatial audio decoders to restore specific decorrelation properties between two or more signals that are reconstructed from one or several downmix signals. The application of decorrelators significantly improves the perceptual quality of the output signal, e.g. when compared to intensity stereo. Specifically, the use of decorrelators enables the proper synthesis of spatial sound with a wide sound image, several concurrent sound objects and/or ambience. However, decorrelators are also known to introduce artifacts like changes in temporal signal structure, timbre, etc.

Other application examples of decorrelators in audio processing are e.g. the generation of artificial reverberation to change the spatial impression or the use of decorrelators in multi-channel acoustic echo cancellation systems to improve the convergence behavior.

One important spatial audio coding scheme is Parametric Stereo (PS). FIG. 1 illustrates the structure of a mono-to-stereo decoder. A single decorrelator generates a decorrelated signal D (a "wet" signal) from a mono input signal M (a "dry" signal). The decorrelated signal D is then fed into a mixer along with the signal M. Then, the mixer applies a mixing matrix H to the input signals M and D to generate the output signals L and R. The coefficients in the mixing matrix H can be fixed, signal dependent or controlled by a user.

Alternatively, the mixing matrix is controlled by side information that is transmitted along with a downmix and contains the parametric description on how to upmix the signals of the downmix to form the desired multi-channel output. The spatial side information is usually generated during the mono downmix process in an accordant signal encoder.

Spatial audio coding as described above is widely applied, e.g., in Parametric Stereo. A typical structure of a parametric stereo decoder is shown in FIG. 2. In FIG. 2, decorrelation is performed in a transform domain. The spatial parameters can be modified by a user or additional tools, e.g. post-processing for binaural rendering/presentation. In this case, the upmix parameters are combined with the parameters from the binaural filters to compute the input parameters for the mixing matrix.

The output L/R of the mixing matrix H is computed from the mono input signal M and the decorrelated signal D.

$$\begin{bmatrix} L \\ R \end{bmatrix} = \begin{bmatrix} h_{11} & h_{12} \\ h_{21} & h_{22} \end{bmatrix} \begin{bmatrix} M \\ D \end{bmatrix}$$

In the mixing matrix, the amount of decorrelated sound fed to the output is controlled on the basis of transmitted parameters, e.g. Inter-Channel Level Differences (ILD), Inter-Channel Correlation/Coherence (ICC) and/or fixed or user-defined settings.

Conceptually, the output signal of the decorrelator output D replaces a residual signal that would ideally allow for a perfect decoding of the original L/R signals. Utilizing the decorrelator output D instead of a residual signal in the upmixer results in a saving of bitrate that would otherwise have been required to transmit the residual signal. The aim of the decorrelator is thus to generate a signal D from the mono signal M, which exhibits similar properties as the residual signal that is replaced by D. Reference is made to the document:

[1] J. Breebaart, S. van de Par, A. Kohlrausch, E. Schuijers, "High-Quality Parametric Spatial Audio Coding at Low Bitrates" in Proceedings of the AES 116$^{th}$ Convention, Berlin, Preprint 6072, May 2004.

Considering MPEG Surround (MPS), structures similar to PS termed One-To-Two boxes (OTT boxes) are employed in spatial audio decoding trees. This can be seen as a generalization of the concept of mono-to-stereo upmix to multi-channel spatial audio coding/decoding schemes. In MPS, there also exist Two-To-Three upmix systems (TTT boxes) that may apply decorrelators depending on the TTT mode of operation. Details are described in the document:

[2] J. Herre, K. Kjörling, J. Breebaart, et al., "MPEG surround—the ISO/MPEG standard for efficient and compatible multi-channel audio coding," in Proceedings of the 122$^{th}$ AES Convention, Vienna, Austria, May 2007.

With respect to Directional Audio Coding (DirAC), DirAC relates to a parametric sound field coding scheme that is not bound to a fixed number of audio output channels with fixed loudspeaker positions. DirAC applies decorrelators in the DirAC renderer, i.e., in the spatial audio decoder to synthesize non-coherent components of sound fields. Directional audio coding is further described in:

[3] Pulkki, Ville: "Spatial Sound Reproduction with Directional Audio Coding", in J. Audio Eng. Soc., Vol. 55, No. 6, 2007

Regarding state-of-the-art decorrelators, reference is made to documents:

[4] ISO/IEC International Standard "Information Technology—MPEG audio technologies—Part1: MPEG Surround", ISO/IEC 23003-1:2007.

[5] J. Engdegard, H. Purnhagen, J. Röden, L. Liljeryd, "Synthetic Ambience in Parametric Stereo Coding" in Proceedings of the AES 116$^{th}$ Convention, Preprint, May 2004.

IIR lattice allpass structures are used as decorrelators in spatial audio decoders like MPS [2,4]. Other state-of-the-art decorrelators apply (potentially frequency dependent) delays to decorrelate signals or convolve the input signals e.g. with exponentially decaying noise bursts. For an overview of state-of-the-art decorrelators for spatial audio upmix systems, reference is made to document [5]: "Synthetic Ambience in Parametric Stereo Coding".

In general, stereo or multichannel applause-like signals coded/decoded in parametric spatial audio coders are known to result in reduced signal quality. Applause-like signals are characterized by containing rather dense mixtures of transients from different directions. Examples for such signals are applause, the sound of rain, galloping horses, etc. Applause-like signals often also contain sound components from distant sound sources that are perceptually fused into a noise-like, smooth background sound field.

Lattice allpass structures employed in spatial audio decoders like MPEG Surround act as artificial reverb generators and are consequently well-suited for generating homogenous, smooth, noise-like, inversive sounds (like room reverberation tails). However, they are examples of sound fields with a non-homogeneous spatio-temporal structure that are still immersing the listener: one prominent example are applause-like sound fields that create listener-envelopment not by only homogeneous noise-like fields, but also by rather dense sequences of single claps from different directions. Hence, the non-homogeneous component of applause sound fields may be characterized by a spatially distributed mixture of transients. These distinct claps are not homogeneous, smooth and noise-like at all.

Due to their reverb-like behavior, lattice allpass decorrelators are incapable of generating immersive sound fields with the characteristics, e.g. of applause. Instead, when applied to applause-like signals, they tend to temporally smear the transients in the signal. The undesired result is a noise-like immersive sound field without the distinctive spatio-temporal structure of applause-like sound fields. Further, transient events like a single handclap might evoke ringing artifacts of the decorrelator filters.

USAC (Unified speech and audio coding) is an audio coding standard for coding of speech and audio and a mixture thereof at different bitrates.

The perceptual quality of USAC can be further improved in stereo coding of applause and applause-like sounds at bitrates in the range of 32 kbps when parametric stereo coding techniques are applicable. USAC coded applause items tend to exhibit a narrow sound stage and a lack of envelopment if no dedicated applause handling is applied within the codec. To a large extent, stereo coding techniques of USAC and their limitations were inherited from MPEG Surround (MPS). However, USAC does offer a dedicated adaption for the requirement of proper applause handling. Said adaption is named Transient Steering Decorrelator (TSD) and is an embodiment of this invention.

Applause signals can be envisioned composed of single, distinct nearby claps temporally separated by a few milliseconds and superimposed noise-like ambience originating from very dense far-off claps. In parametric stereo coding at sensible side-information rate, the granularity of the spatial parameter sets (inter channel level difference, inter channel correlation, etc.) is much too low to ensure a sufficient spatial re-distribution of the single claps, leading to a lack of envelopment. Additionally, the claps are subject to processing by a lattice allpass decorrelator. This inevitably induces a temporal dispersion of the transients and further reduces the subjective quality.

Employing a Transient Steering Decorrelator (TSD) within the USAC decoder results in a modification of MPS processing. The underlying idea of such an approach is to address the applause decorrelation problem as follows:

- Separate the transients in the QMF domain before the lattice allpass decorrelator, i.e.: split the decorrelator input signal into a transient stream s2 and a non-transient stream s1.
- Feed the transient stream to a different parameter-controlled decorrelator, which is well-suited for transient mixtures.
- Feed the non-transient stream to the MPS allpass decorrelator.
- Add the outputs of both decorrelators, $D_1$ and $D_2$ to obtain the decorrelated signal D.

FIG. 3 illustrates a One-To-Two (OTT) configuration within the USAC decoder. The U-shaped transient handling box of FIG. 3 comprises a parallel signal path as proposed for the transient handling.

Two parameters that guide the TSD process are transmitted as frequency independent parameters from the encoder to the decoder (see FIG. 3):

- A binary transient/non-transient decision of a transient detector running in the encoder is used to control the transient separation with QMF time slot granularity in the decoder. An efficient lossless coding scheme is utilized for transmitting the transient QMF slot position data.
- Actual transient decorrelator parameters, which are needed for the transient decorrelator to steer a spatial distribution of transients. The transient decorrelator parameters denote an angle between the downmix and its residual. These parameters are only transmitted for time slots which have been detected at the encoder to contain transients.

In order to assess the quality of the above-described technology, two MUSHRA listening tests were conducted in a controlled listening test environment using high quality electrostatic STAX headphones. The testing was performed at 32 kbps and 16 kbps stereo configuration. Sixteen expert listeners participated in each of the tests.

Since the USAC test set does not contain applause items, additional applause items have been chosen to demonstrate the benefit of the proposed technology. The items listed in Table 1 have been included in the test:

TABLE 1

Items of the listening test:

| Item | Properties |
|---|---|
| ARL_applause | applause with low to medium density (MPS testset item) |
| applause4s | very dense applause containing few distinct claps |
| Applse_2ch | dense multi-channel applause - front channels (MPS testset item) |
| Applse_st | dense multi-channel applause - stereo downmix (MPS testset item) |
| Klatschen | sparse applause signal |

Regarding the regular twelve MPEG USAC listening test items, TSD is never active. However, these items do not remain exactly bit-identical since the TSD enable bit (indicating that TSD is off) is additionally included in the bitstream and thus slightly affects the bit-budget for the core-coder. Since these differences are very small, these items were not included in the listening test. Data is provided on the size of these differences to show that these changes are negligible and imperceptible.

A codec tool named inter-TES is part of USAC reference model 8 (RM8). Since this technique has been reported to improve the perceptual quality of transients including applause-like signals, inter-TES was switched on in every test condition. In such a setting, the best possible quality is insured and the orthogonality of inter-TES and TSD is demonstrated.

The system tests have the following configurations:

RM8: USAC RM8 system

CE: USAC RM8 system enhanced by the Transient Steering Decorrelator (TSD)

FIGS. 4 and 5 depict the MUSHRA scores along with their 95% confidence intervals for the 32 kbps test scenario. For the test data, Student's t-distribution was assumed. The absolute scores in FIG. 4 show a higher mean score for all items, for four out of five items there is a significant improvement in the 95% confidence sense. No item was degraded versus RM8. The difference scores for USAC+TSD, as evaluated in a TSD core experiment (CE) with respect to USAC RM8 are plotted in FIG. 5. Here, a significant improvement for all items can be seen.

For the 16 kbps test setup, FIGS. 6 and 7 depict the MUSHRA scores along with their 95% confidence intervals. Student's t-distribution of the data was assumed. The absolute scores in FIG. 6 show higher mean score for every item. For one item, significance in the 95% confidence sense can be seen. No item scored worse than RM8. The difference scores are plotted in FIG. 7. Again, a significant improvement for all items with respect to different data was demonstrated.

The TSD tool is enabled by a bsTsdEnable flag transmitted in the bitstream. If TSD is enabled, the actual separation of transients is controlled by transient detection flags TsdSepData that are also transmitted in the bitstream and which are encoded in bsTsdCodedPos in case TSD is enabled.

In the encoder, the TSD enable flag bsTsdEnable is generated by a segmental classifier. The transient detection flags TsdSepData are set by a transient detector.

As already pointed out, TSD is not activated for the twelve MPEG USAC test items. For the five additional applause items TSD activation is depicted in FIG. 8, displaying a bsTsdEnable logic state versus time.

If TSD is activated, transients are detected in certain QMF time slots and these are subsequently fed to the dedicated transient decorrelator. For each additional test item, Table 2 lists percentages of slots within TSD activated frames which comprise transients.

TABLE 2

Transient slot percentage (transient slot density in % of all time slots of TSD frames)

| Item | Transient slot density (%) |
|---|---|
| ARL_applause | 23.4 |
| Applause4s | 20.1 |
| applse_2ch | 24.7 |
| applse_st | 23.8 |
| Klatschen | 21.3 |

Transmitting transient separation decisions and decorrelator parameters from the encoder to the decoder does necessitate a certain amount of side information. However, this amount is overcompensated by the bitrate savings originating from the transmission of broadband spatial cues within MPS.

In consequence, the mean MPS+TSD side information bitrate is even lower than the plain MPS side information bitrate in plain USAC as listed in Table 3, first column. In the proposed configuration, as utilized for assessment of subjective quality, the mean bitrates listed in Table 3, second column, have been measured for TSD:

TABLE 3

MPS(+TSD) Bitrates in bits/second within a 32 kbps stereo codec scenario:

| | MPS(+TSD) side information mean bitrate (bits/sec.) | |
|---|---|---|
| Item | plain USAC RM8 | USAC with TSD |
| ARL_applause | 2966 | 2345 |
| Applause4s | 2754 | 2278 |
| applse_2ch | 3000 | 2544 |
| applse_st | 2735 | 2253 |
| Klatschen | 2950 | 2495 |

The computational complexity of TSD arises from the transient slot position decoding the transient decorrelator complexity.

Assuming an MPEG Surround spatial frame length of 32 time slots, the slot position decoding necessitates (64 divisions+80 multiplications) per spatial frame in the worst case, i.e., 64*25+80=1680 operations per spatial frame.

Ignoring copy operations and conditional statements, the transient decorrelator complexity is given by one complex multiplication per slot and hybrid QMF band.

This leads to the following overall complexity numbers of TSD, shown in comparison to the plain USAC complexity numbers in Table 4:

TABLE 4

TSD decoder complexity in MOPS and relative to plain USAC decoder complexity:

| | plain USAC complexity in MOPS | TSD: transient decorrelator complexity in MOPS | TSD: slot position decoder complexity in MOPS | Σ(TSD complexity) in MOPS | Σ(TSD complexity) relative to plain USAC |
|---|---|---|---|---|---|
| 16 kbps stereo ($f_s$ = 28.8 kHz) | 8.7 | 0.117 | 0.024 | 0.141 | 1.62% |
| 32 kbps stereo ($f_s$ = 40 kHz) | 13.2 | 0.163 | 0.033 | 0.196 | 1.48% |

In summary, the listening test data clearly shows a significant improvement of subjective quality of applause signals in the difference scores of all items in both operation points. In terms of absolute scores, all items in the TSD condition exhibit a higher mean score. For 32 kbps, a significant improvement exists for four out of five items. For 16 kbps, one item shows significant improvement. None of the items scored worse than RM8. An improvement is achieved at, as can be seen from the data on complexity, negligible computational costs. This further emphasizes the benefit of the TSD tool for USAC.

The above-described Transient Steering Decorrelator significantly improves audio processing in USAC. However, as has also been seen above, a Transient Steering Decorrelator necessitates information about the existence or non-existence of transients in a particular slot. In USAC, information about time slots may be transmitted on a frame-by-frame basis. A frame comprises several, e.g., 32 time slots. It is therefore appreciated that an encoder also transmits information about which slots comprise transients on a frame-by-frame basis. Reducing the number of bits to be transmitted is critical in audio signal processing. As even a single audio recording comprises a vast number of frames this means that even if the number of bits to be transmitted for each frame is reduced by just a few bits, the overall bit transfer rate can be significantly reduced.

The problem of decoding slot positions of events in an audio signal frame is however not limited to the problem of decoding transients. It would moreover be useful to decode slot positions of other events as well, such as, whether a slot of an audio signal frame is tonal (or not), whether it comprises noise (or whether it doesn't) and the like. In fact, an apparatus for efficiently encoding and decoding slot positions of events in an audio signal frame would be very useful for a large number of different sorts of events.

When this document refers to slots or slot positions of an audio signal frame, slots in this sense may be time slots, frequency slots, time-frequency slots or any other kind of slots. It is furthermore understood that the present invention is not limited to audio processing and audio signal frames in USAC, but instead refers to any kind of audio signal frames and any kind of audio formats, such as MPEG1/2, Layer 3 ("MP3"), Advanced Audio Coding (AAC), and the like. Efficiently encoding and decoding slot positions of events in an audio signal frame would be very useful for any kind of audio signal frame.

SUMMARY

According to an embodiment, an apparatus for decoding an encoded audio signal having an audio signal frame having slots and events associated with the slots may have: an analysing unit for analysing a frame slots number indicating the total number of slots of the audio signal frame, an event slots number indicating the number of slots having the events of the audio signal frame, and an event state number; and a generating unit for generating an indication of a plurality of positions of slots having the events in the audio signal frame using the frame slots number, the event slots number and the event state number.

According to another embodiment, an apparatus for encoding positions of slots having events in an audio signal frame may have: an event state number generator for encoding the positions of slots by encoding an event state number; and a slot information unit, being adapted to provide a frame slots number indicating the total number of slots of the audio signal frame and an event slots number indicating the number of slots having the events of the audio signal frame to the event state number generator, wherein the event state number, the frame slots number and the event slots number together indicate a plurality of positions of slots having the events in the audio signal frame.

According to still another embodiment, a method for decoding positions of slots having events in an audio signal frame may have the steps of: analysing a frame slots number indicating the total number of slots of the audio signal frame, an event slots number indicating the number of slots having the events of the audio signal frame, and an event state number; and generating an indication of a plurality of positions of slots having the events in the audio signal frame using frame slots number, the event slots number and the event state number.

According to another embodiment, a method for encoding positions of slots having events in an audio signal frame may have the steps of: receiving or determining a frame slots number indicating the total number of slots of the audio signal frame, receiving or determining an event slots number indicating the number of slots having the events of the audio signal frame, and encoding an event state number based on the event state number, the frame slots number and the event slots number, such that an indication of a plurality of positions of slots having the events in the audio signal frame can be decoded by using frame slots number, the event slots number and the event state number.

Another embodiment may have a computer program for decoding positions of slots having events in an audio signal frame implementing a method for decoding slot positions of the events in an audio signal frame as mentioned above.

Another embodiment may have a computer program for encoding positions of slots having events in an audio signal frame implementing a method for encoding slot positions of the events in an audio signal frame as mentioned above.

Still another embodiment may have an encoded audio signal having an event state number, wherein the positions of slots having events can be decoded according to the above method for decoding positions of slots having events in an audio signal frame.

The present invention assumes that a frame slots number indicating the total number of slots of an audio signal frame and an event slots number indicating the number of slots comprising events of the audio signal frame may be available in a decoding apparatus of the present invention. For example, an encoder may transmit the frame slots number and/or the event slots number to the apparatus for decoding. According to an embodiment, the encoder may indicate the total number of slots of an audio signal frame by transmitting a number which is the total number of slots of an audio signal frame minus 1. The encoder may further indicate the number of slots comprising events of the audio signal frame by transmitting a number which is the number of slots comprising events of the audio signal frame minus 1. Alternatively, the decoder may itself determine the total number of slots of an audio signal frame and the number of slots comprising events of the audio signal frame without information from an encoder.

Based on these assumptions, according to the present invention, the number of slot positions comprising events in an audio signal frame can be encoded and decoded using the following findings:

Let N be the total number of slots of an audio signal frame, and let P be the number of slots comprising events of the audio signal frame.

It is assumed that both the apparatus for encoding as well as the apparatus for decoding are aware of the values of N and P.

Knowing N and P, it can be derived that there are only $$\binom{N}{P}$$

different combinations of positions of slots comprising events in an audio signal frame.

For example, if the slot positions in a frame are numbered from 0 to N−1 and if P=8, then a first possible combination of slot positions with events would be (0, 1, 2, 3, 4, 5, 6, 7), a second one would be (0, 1, 2, 3, 4, 5, 6, 8), and so on, up to the combination (N−8, N−7, N−6, N−5, N−4, N−3, N−2, N−1), so that in total there are $$\binom{N}{P}$$

different combinations.

Moreover, the present invention employs the further finding, that an event state number may be encoded by an apparatus for encoding and that the event state number is transmitted to the decoder. If each of the possible $$\binom{N}{P}$$

combinations is represented by a unique event state number and if the apparatus for decoding is aware which event state number represents which combination of slot positions comprising events in an audio signal frame (e.g. by applying an appropriate decoding method), then the apparatus for decoding can decode the slot positions comprising events using N, P and the event state number. For a lot of typical values for N and P, such a coding technique employs fewer bits for encoding slot positions of events compared to other methods (e.g. employing a bit array with one bit for each slot of the frame, wherein each bit indicates whether an event occurred in this slot or not).

Stated differently, the problem of encoding the slot positions of events in an audio signal frame can be solved by encoding a discrete number P of positions $p_k$ on a range of [0 . . . N−1], such that the positions are not overlapping $p_k \neq p_h$ for $k \neq h$, with as few bits as possible. Since the ordering of positions does not matter, it follows that the number of unique combinations of positions is the binominal coefficient $$\binom{N}{P}.$$

The number of bits necessitated is thus $$\text{bits} = \text{ceil}\left(\log_2\left(\binom{N}{P}\right)\right)$$

In an embodiment, an apparatus for decoding is provided, wherein the apparatus for decoding is adapted to conduct a test comparing an event state number or an updated event state number with a threshold value. Such a test may be employed to derive the positions of slots comprising events from an event state number. The test of comparing an event state number with a threshold value may be conducted by comparing, whether the event state number or an updated event state number is greater than, greater than or equal to, smaller than, or smaller than or equal to the threshold value. Furthermore, it is of advantage that the apparatus for decoding is adapted to update the event state number or an updated event state number depending on the result of the test.

According to an embodiment, an apparatus for decoding is provided which is adapted to conduct the test comparing an event state number or an updated event state number with respect to a particular considered slot, wherein the threshold value depends on the frame slots number, the event slots number and on the position of the considered slot within the frame. By this, the positions of slots comprising events may be determined on a slot-by-slot basis, deciding for each slot of a frame, one after the other, whether the slot comprises an event.

According to a further embodiment, an apparatus for decoding is provided which is adapted to split the frame into a first frame partition comprising a first set of slots of the frame and into a second frame partition comprising a second set of slots of the frame, and wherein the apparatus for decoding is further adapted to determine the positions comprising events for each of the frame partitions separately. By this, the positions of slots comprising events may be determined by repeatedly splitting a frame or frame partitions in even smaller frame partitions.

BRIEF DESCRIPTION OF THE DRAWINGS

In the following, embodiments of the present invention are described in more detail with respect to the figures, wherein:

FIG. 11 illustrates a pseudo code implementing the decoding of positions of slots comprising events according to an embodiment of the present invention;

FIG. 17 illustrates the syntax of TsdData of USAC according to an embodiment;

FIG. 18 illustrates an nBitsTrSlots table depending on MPS frame length;

FIG. 19 shows a table relating to bsTempShapeConfig of USAC according to an embodiment;

FIG. 20 depicts the syntax of TempShapeData of USAC according to an embodiment;

FIG. 22 depicts the syntax of EcData of USAC according to an embodiment.

DETAILED DESCRIPTION OF THE INVENTION

Figure 9A:
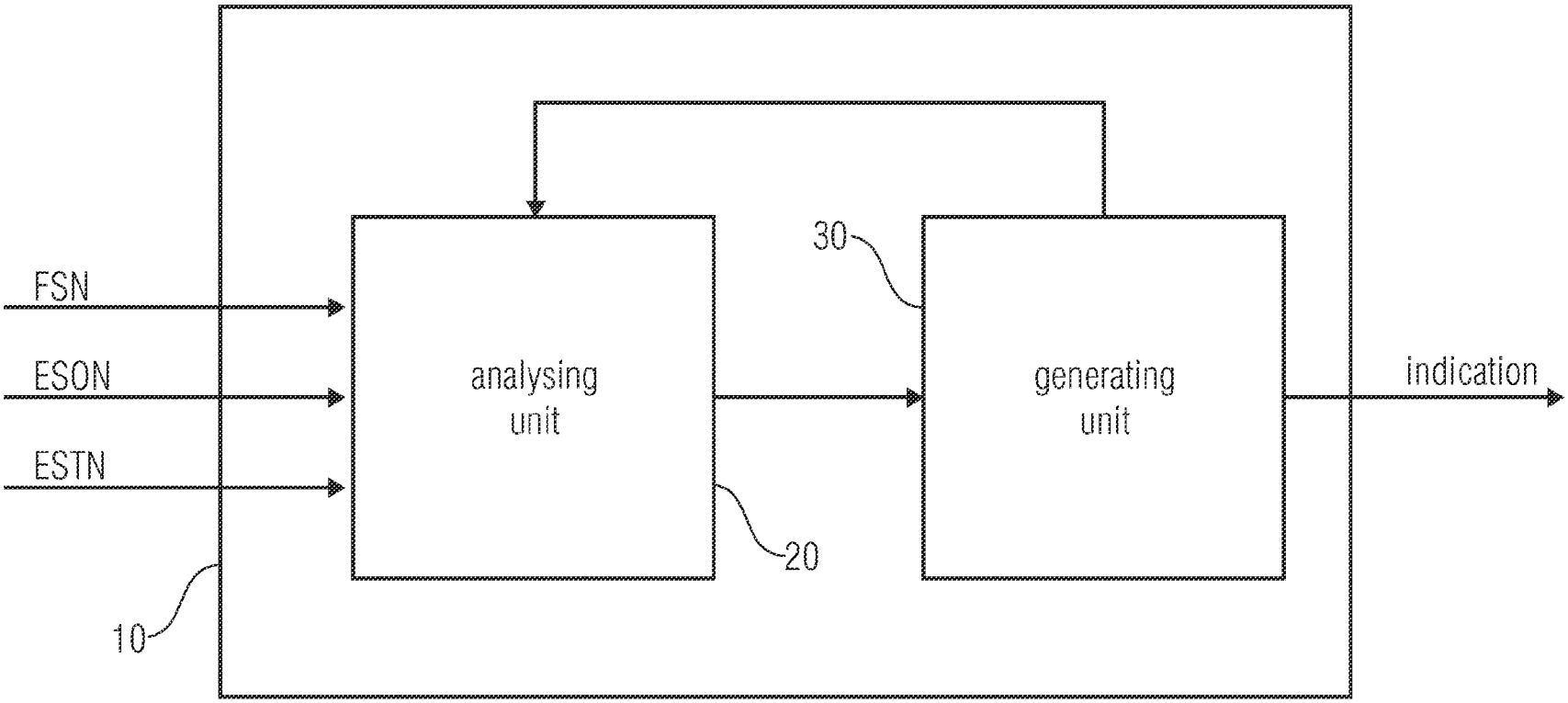
FIG. 9*a* illustrates an apparatus for decoding positions of slots comprising events in an audio signal frame according to an embodiment of the present invention.

FIG. 9*a* illustrates an apparatus 10 for decoding positions of slots comprising events in an audio signal frame according to an embodiment of the present invention. The apparatus for decoding 10 comprises an analysing unit 20 and a generating unit 30. A frame slots number FSN, indicating the total number of slots of an audio signal frame, an event slots number ESON indicating the number of slots comprising events of the audio signal frame, and an event state number ESTN are fed into the apparatus for decoding 10. The apparatus for decoding 10 then decodes the positions of slots comprising events by using the frame slots number FSN, the event slots number ESON and the event state number ESTN. Decoding is conducted by the analysing unit 20 and the generating unit 30 which cooperate in the process of decoding. While the analysing unit 20 is responsible for executing tests, e.g. comparing the event state number ESTN with a threshold value, the generating unit 30 generates and updates intermediate results of the decoding process, e.g. an updated event state number.

Furthermore the generating unit 30 generates an indication of a plurality of positions of slots comprising events in the audio signal frame. The particular indication of a plurality of positions of slots comprising events of the audio signal frame may be referred to as an "indication state".

According to an embodiment, the indication of a plurality of positions of slots comprising the events in the audio signal frame may be generated such that at a first point in time, the generating unit 30 indicates for a first slot, whether the slot comprises an event or not, at a second point in time, the generating unit 30 indicates for a second slot, whether the slot comprises an event or not and so on.

According to a further embodiment, the indication of a plurality of positions of slots comprising events may for example be a bit array indicating for each slot of the frame whether it comprises an event.

The analysing unit 20 and the generating unit 30 may cooperate such that both units call each other one or more times in the process of decoding to produce intermediate results.

Figure 1:
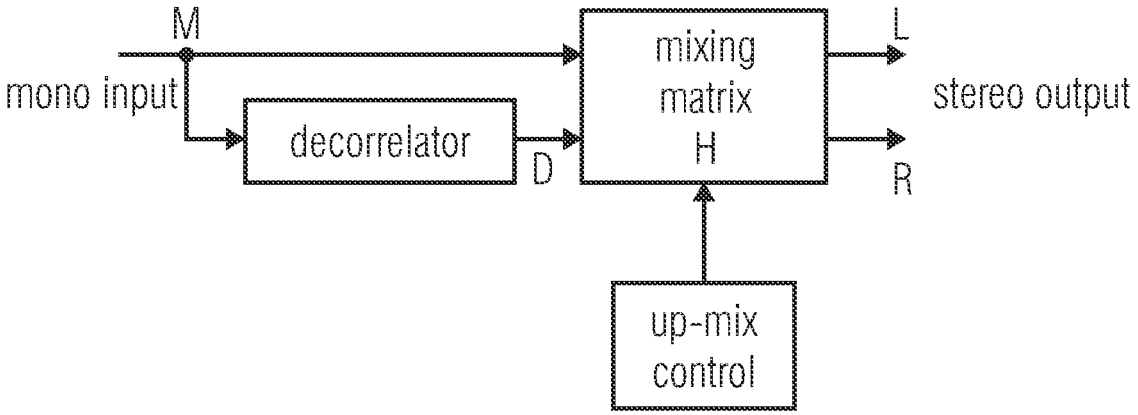
FIG. 1 is a typical application of a decorrelator in a mono-to-stereo upmixer.
Figure 2:
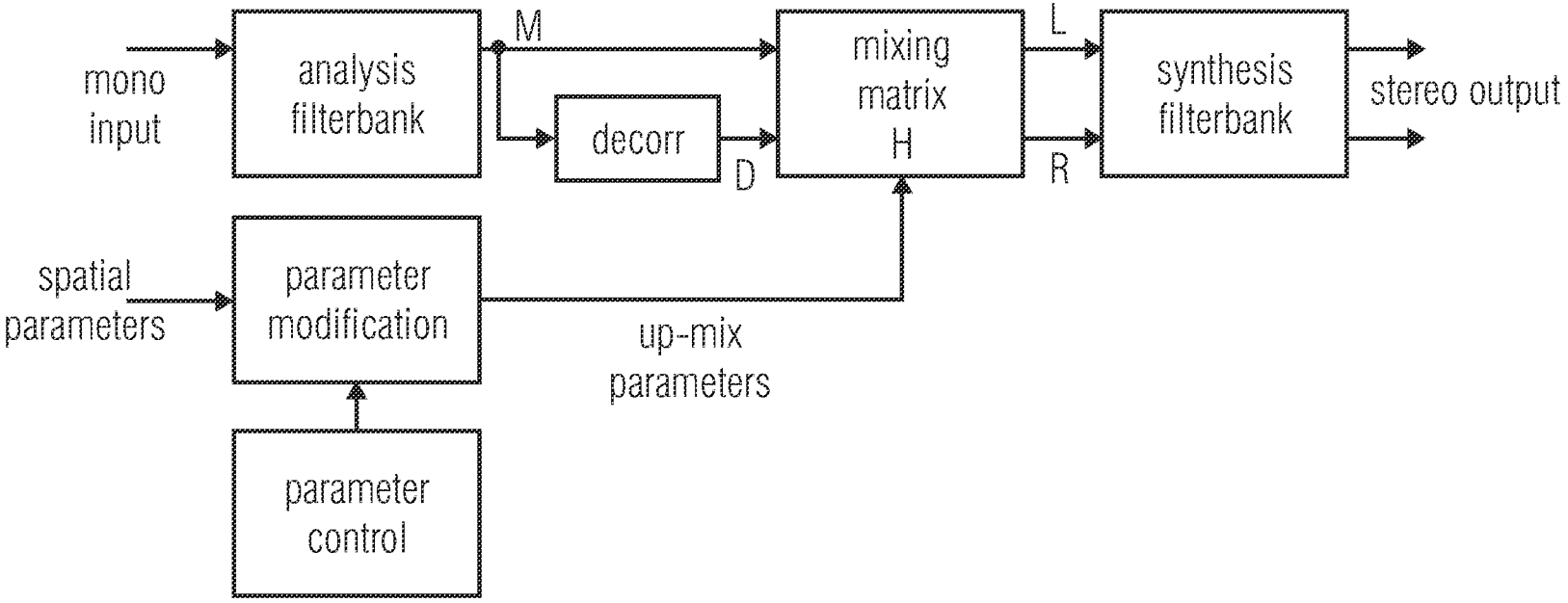
FIG. 2 is a further typical application of a decorrelator in a mono-to-stereo upmixer.
Figure 3:
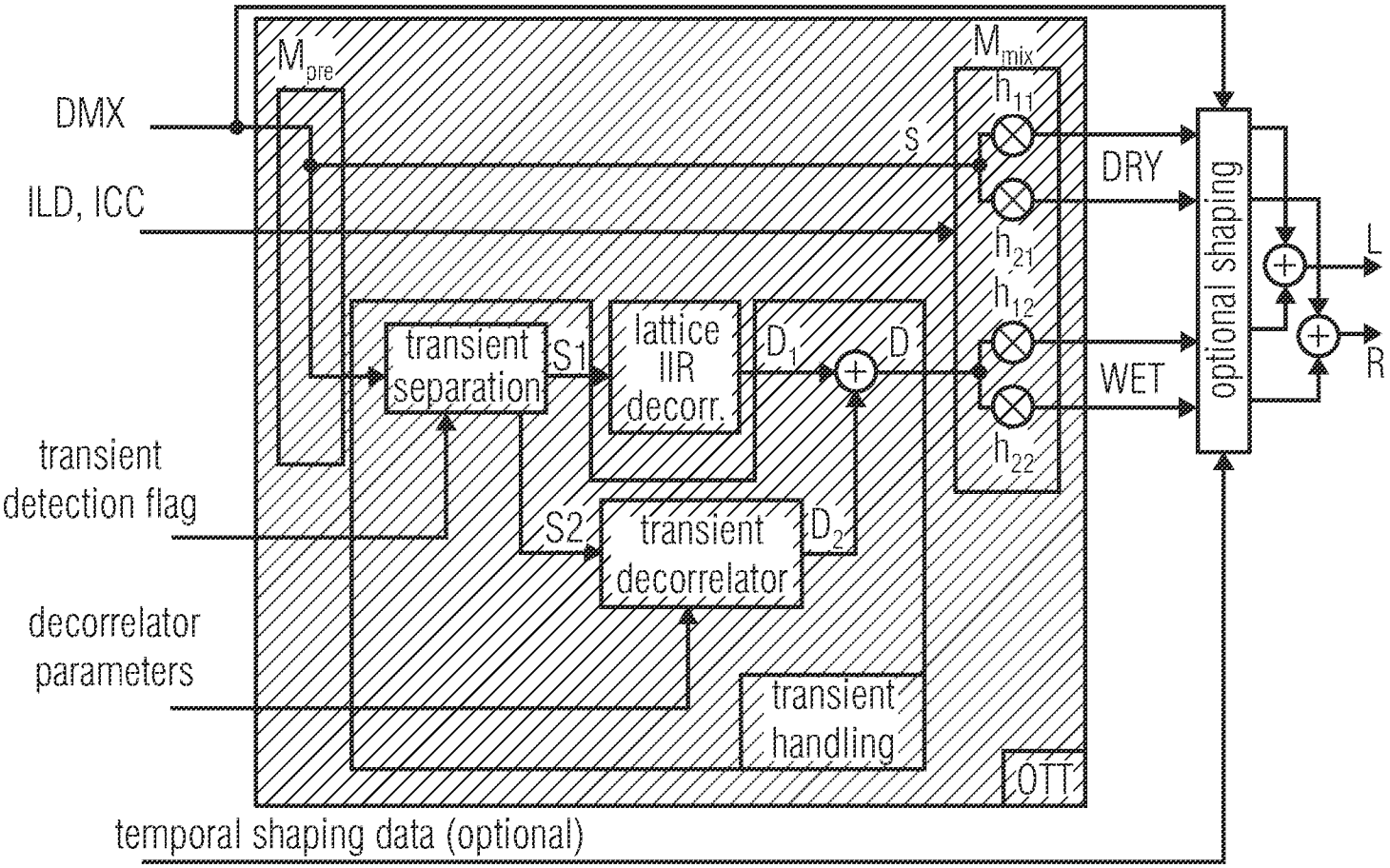
FIG. 3 is a One-To-Two (OTT) system overview including a Transient Steering Decorrelator (TSD)
Figure 4:
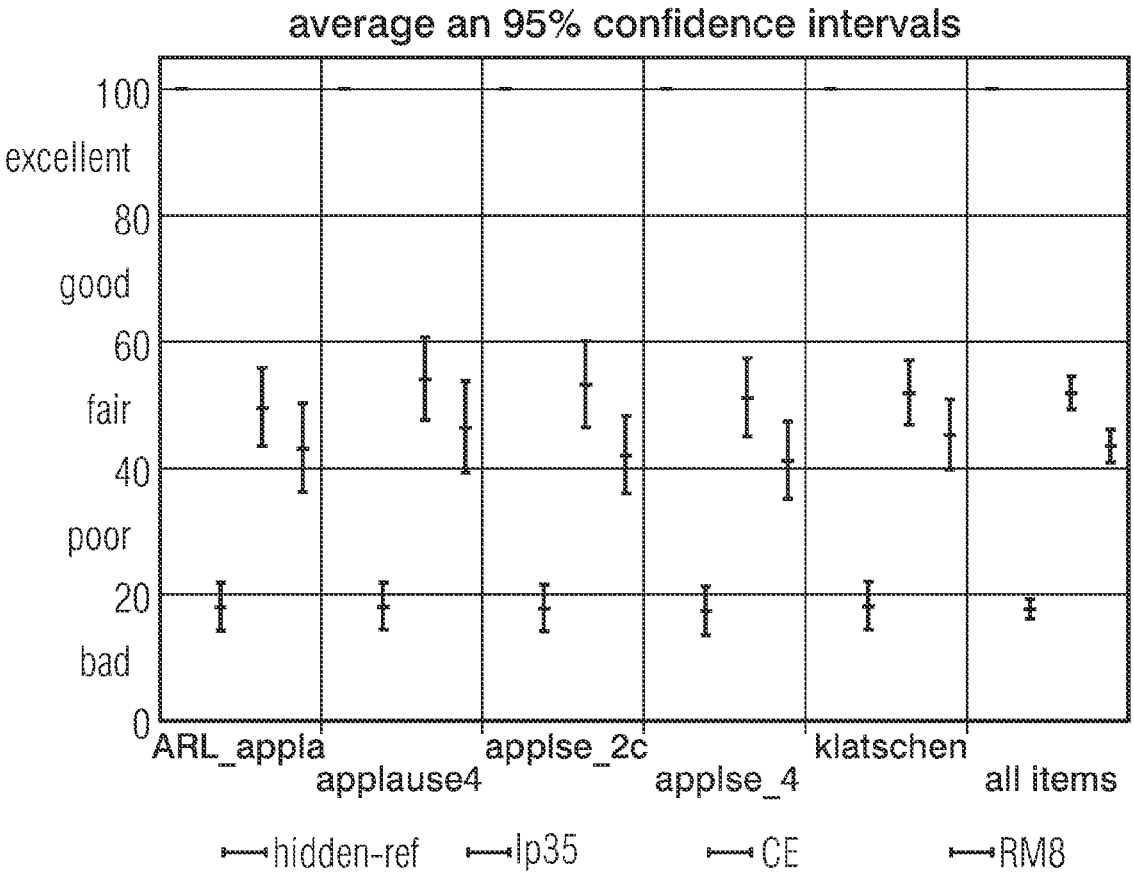
FIG. 4 is a diagram illustrating absolute scores for 32 kbps stereo comparing RM8 USAC and USAC RM8+TSD in a TSD core experiment (CE)
Figure 5:
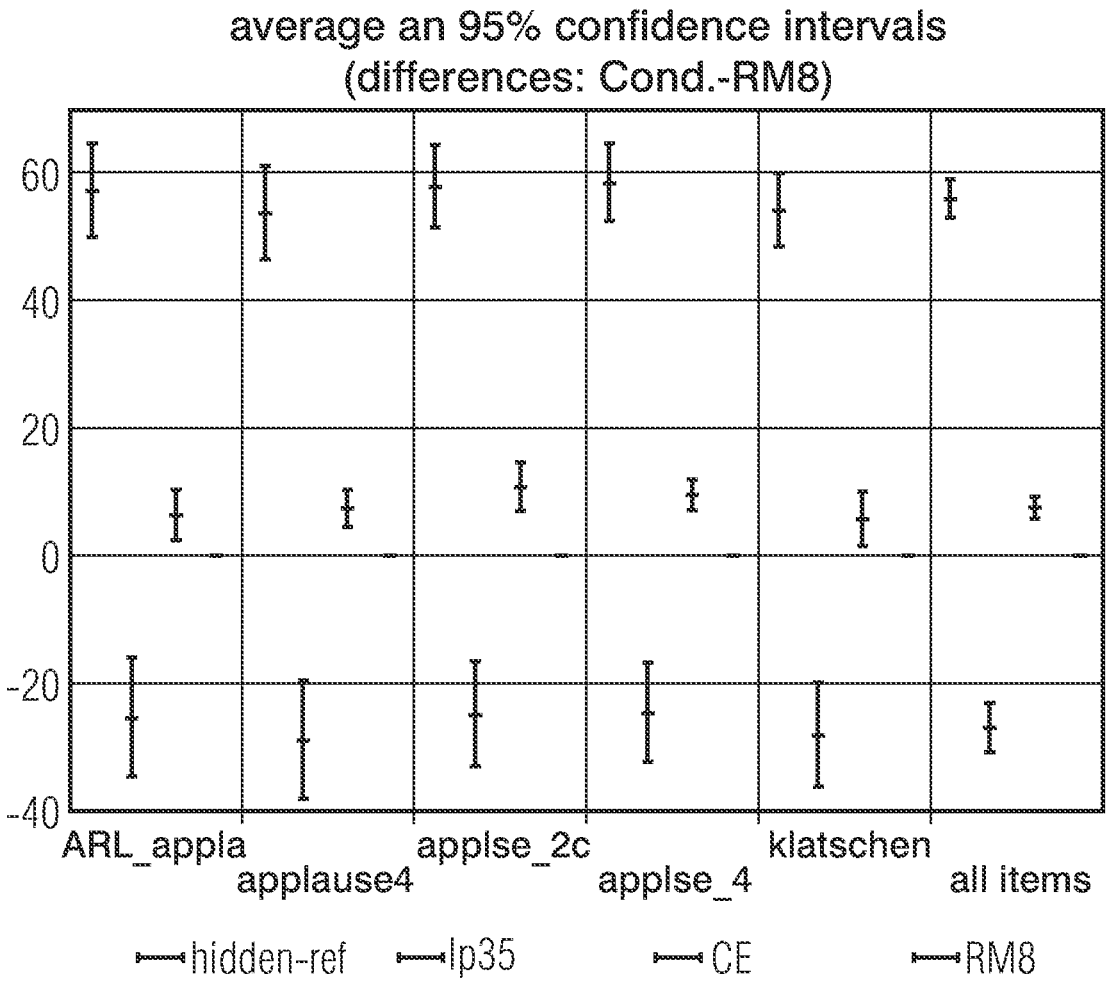
FIG. 5 is a diagram displaying differential scores for 32 kbps stereo comparing USAC employing a Transient Steering Decorrelator versus a plain USAC system.
Figure 6:
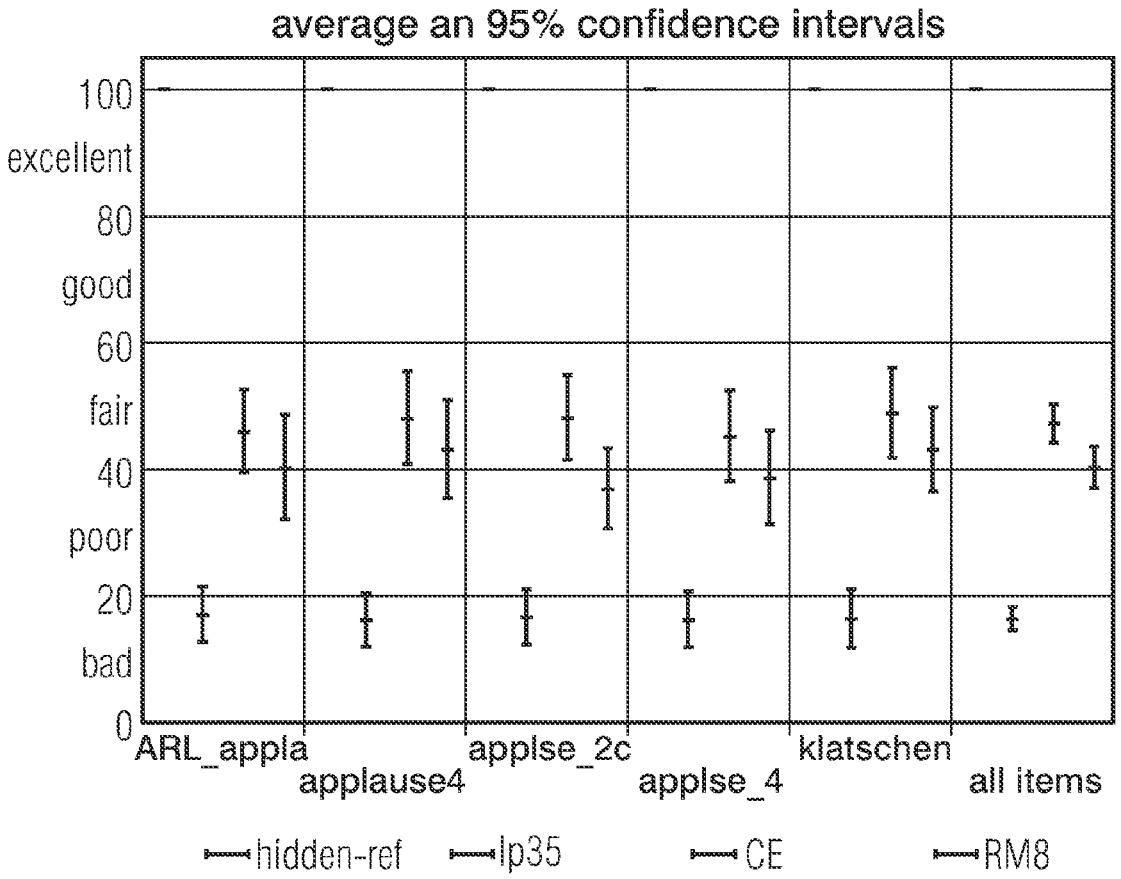
FIG. 6 is a diagram displaying absolute scores for 16 kbps stereo comparing RM8 USAC and USAC RM8+TSD in a TSD core experiment (CE)
Figure 7:
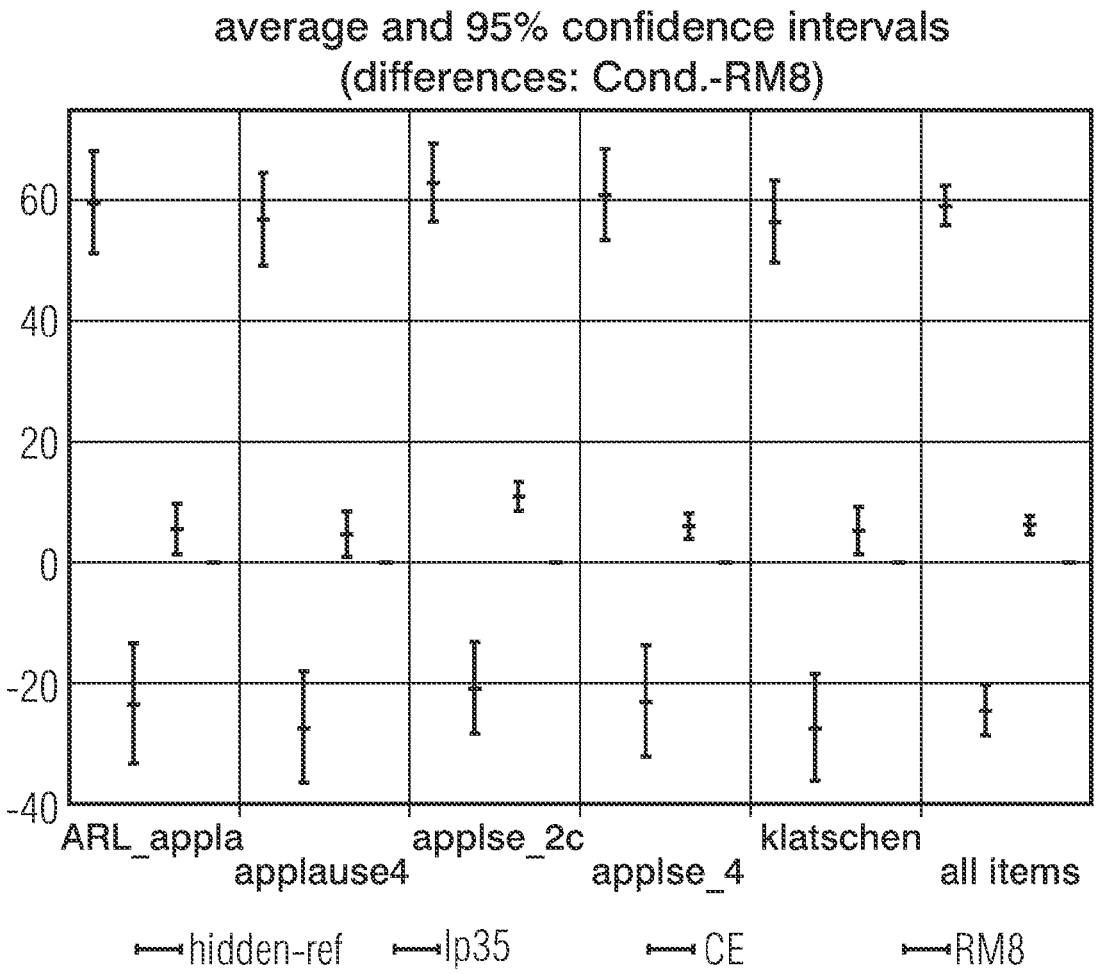
FIG. 7 is a diagram displaying differential scores for 16 kbps stereo comparing USAC employing a transient steering decorrelator versus a plain USAC system.
Figure 8:
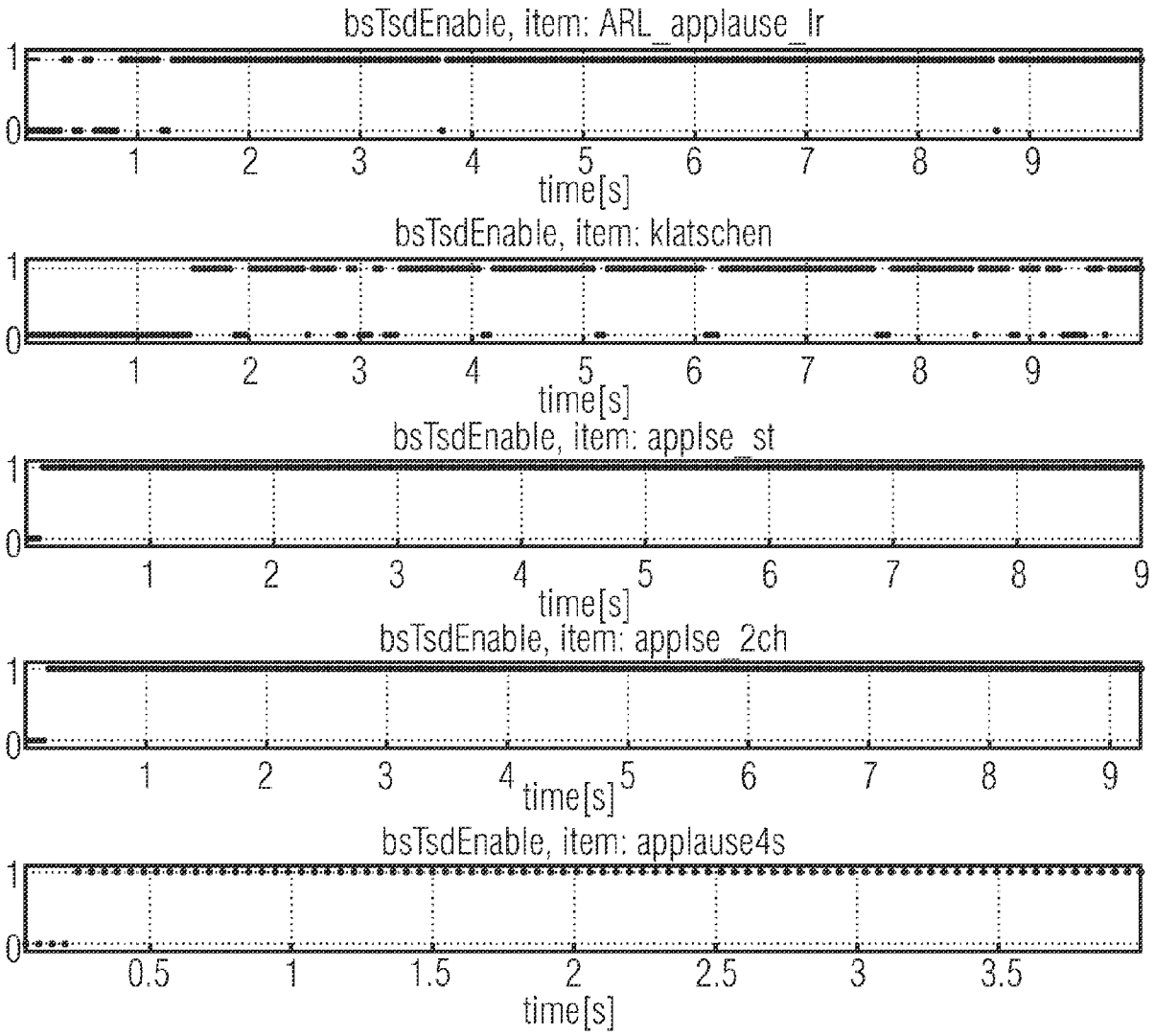
FIG. 8 displays TSD activity for five additional items depicted as logic status of the bsTsdEnable flag.
Figure 9B:
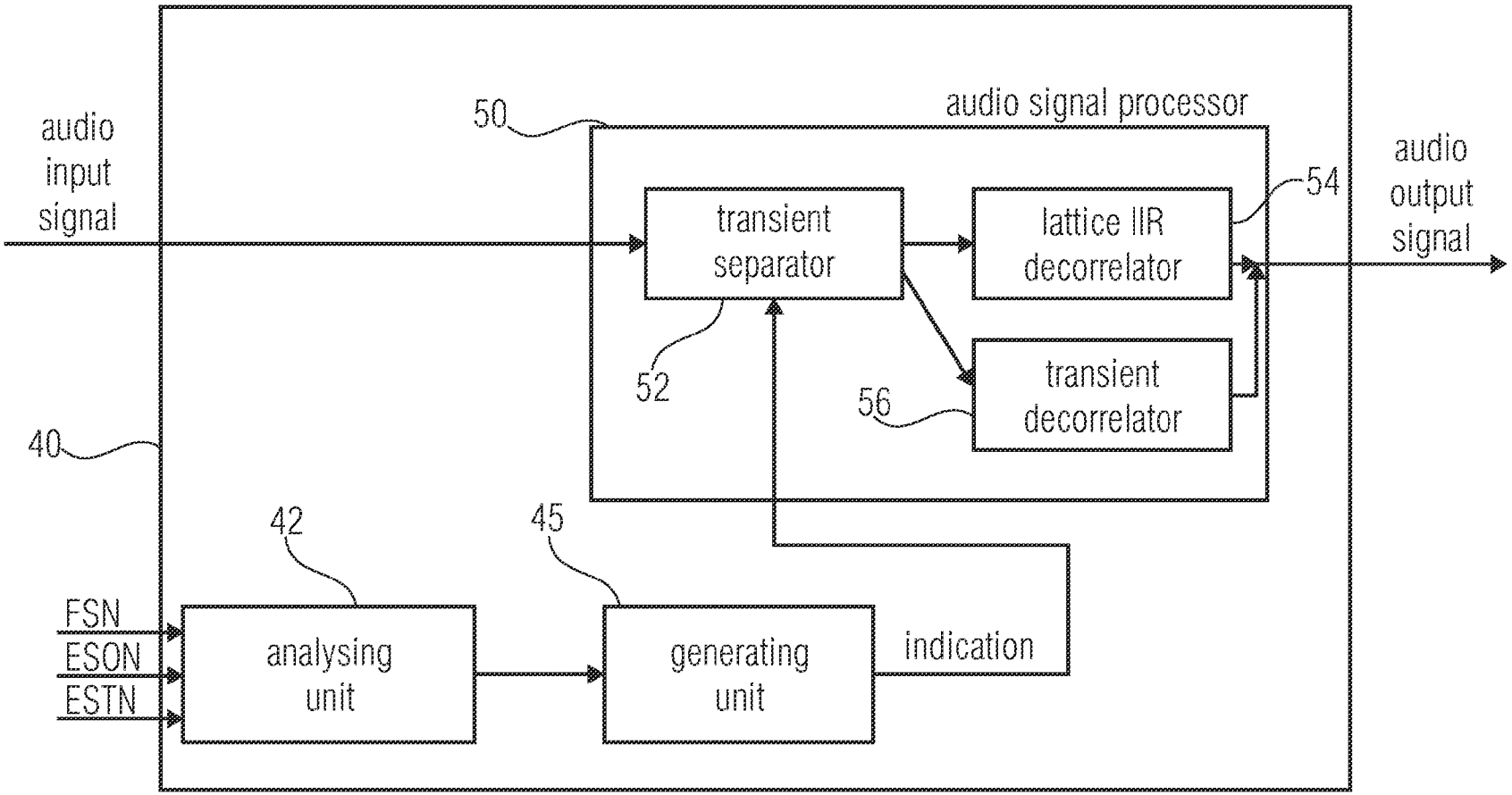
FIG. 9*b* illustrates an apparatus for decoding positions of slots comprising events in an audio signal frame according to an further embodiment of the present invention.

FIG. 9*b* illustrates an apparatus for decoding 40 according to an embodiment of the present invention. The apparatus for decoding 40 inter alia differs from the apparatus 10 of FIG. 9*a* in that it further comprises an audio signal processor 50. The audio signal processor 50 receives an audio input signal and the indication of a plurality of positions of slots comprising the events in the audio signal frame which was generated by a generating unit 45. Depending on the indication, the audio signal processor 50 generates an audio output signal. The audio signal processor 50 may generate the audio output signal, e.g., by decorrelating the audio input signal. Furthermore the audio signal processor 50 may comprise a lattice IIR decorrelator 54, a transient decorrelator 56 and a transient separator 52 for generating the audio output signal as illustrated in FIG. 3. If the indication of a plurality of positions of slots comprising the events in the audio signal frame indicates that a slot comprises a transient, then the audio signal processor 50 will decorrelate the audio input signal relating to that slot by the transient decorrelator 56. If, however, the indication of a plurality of positions of slots comprising the events in the audio signal frame indicates that a slot does not comprise a transient, then the audio signal processor will decorrelate the audio input signal S relating to that slot by employing the lattice IIR decorrelator 54. The audio signal processor employs the transient separator 52 which decides based on the indication whether a portion of the audio input signal relating to a slot is fed into the transient decorrelator 56 or into the lattice IIR decorrelatior 54, depending on whether the indication indicates that the particular slot comprises a transient (decorrelation by the transient decorrelator 56) or whether the slot does not comprise a transient (decorrelation by the lattice IIR decorrelator 54).

Figure 9C:
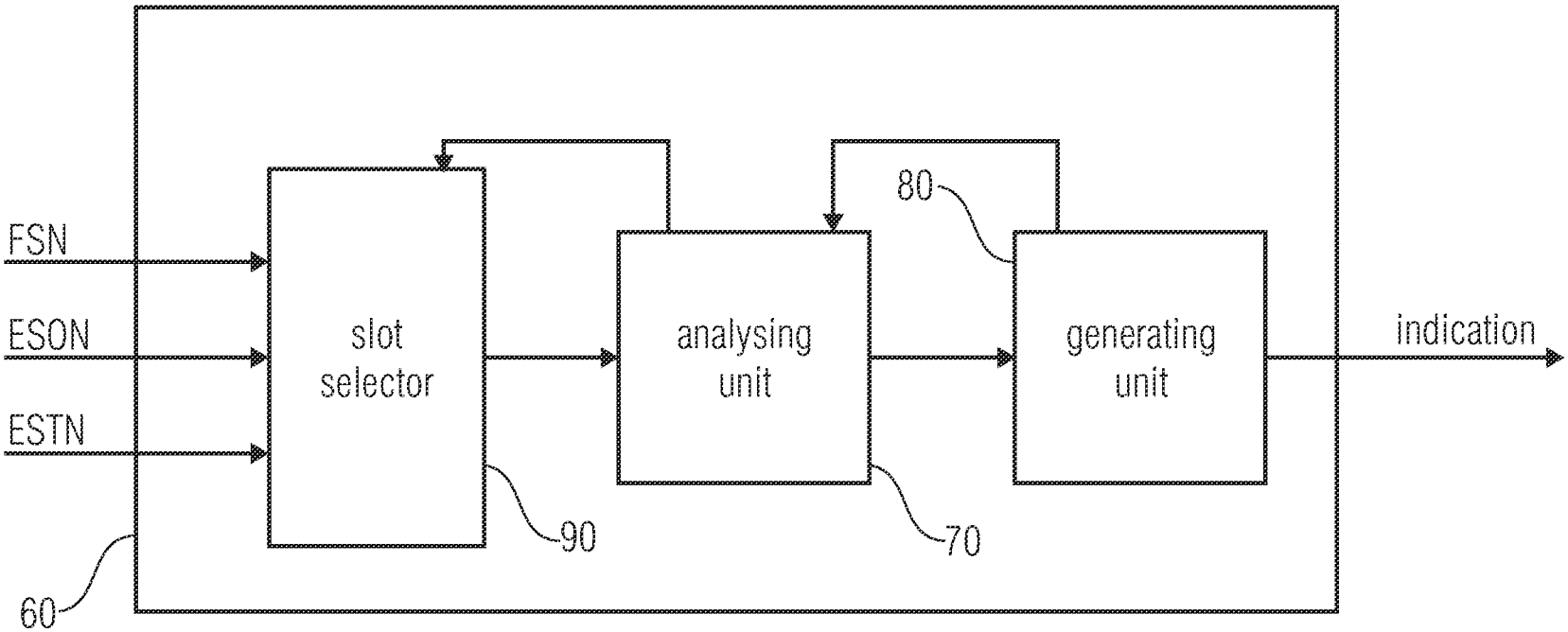
FIG. 9*c* illustrates an apparatus for decoding positions of slots comprising events in an audio signal frame according to another embodiment of the present invention.

FIG. 9*c* illustrates an apparatus for decoding 60 according to an embodiment of the present invention. The apparatus for decoding 60 differs from the apparatus 10 of FIG. 9*a* in that it further comprises a slot selector 90. Decoding is done on a slot-by-slot basis deciding for each slot of a frame, one after the other, whether the slot comprises an event.

The slot selector 90 decides, which slot of a frame to consider. An advantageous approach would be that the slot selector 90 chooses the slots of a frame one after the other.

The slot-by-slot decoding of the apparatus for decoding 60 of this embodiment is based on the following findings, which may be applied for embodiments of an apparatus for decoding, an apparatus for encoding, a method for decoding and a method for encoding positions of slots which comprise events in an audio signal frame. The following findings are also applicable for respective computer programs and encoded signals:

Assume that N is the (total) number of slots of an audio signal frame and P is the number of slots comprising events of the frame (this means that N may be the frame slots number FSN and P may be the event slots number ESON). The first slot of a frame is considered. Two cases may be distinguished:

If the first slot is a slot which does not comprise an event, then, with respect to the
remaining N−1 slots of the frame, there are only $$\binom{N-1}{P}$$

different possible combinations of the P slot positions comprising an event with respect to the remaining N−1 slots of the frame.

However, if the first slot is a slot comprising an event, then, with respect to the remaining N−1 slots of the frame, there are only $$\binom{N-1}{P-1}=\binom{N}{P}-\binom{N-1}{P}$$

different possible combinations of the remaining P−1 slots comprising an event with respect to the remaining N−1 slots of the frame.

Based on this finding, embodiments are further based on the finding that all combinations with a first slot where an event has not occurred, should be encoded by event state numbers that are smaller than or equal to a threshold value. Furthermore, all combinations with a first slot where an event has occurred, should be encoded by event state numbers that are greater than a threshold value. In an embodiment, all event state numbers may be positive integers or 0 and a suitable threshold value regarding the first slot may be $$\binom{N-1}{P}.$$

In an embodiment, an apparatus for decoding is adapted to determine, whether the first slot of a frame comprises an event by testing, whether the event state number is greater than a threshold value. (Alternatively, the encoding/decoding process of embodiments may also be realized, such that an apparatus for decoding tests, whether the event state number is greater than or equal to, smaller than or equal to, or smaller than a threshold value.) After analysing the first slot, decoding is continued for the second slot of the frame using adjusted values: Besides adjusting the number of considered slots (which is reduced by one), the number of slots comprising events is also eventually reduced by one (if the first slot did comprise an event) and the event state number is adjusted, in case the event state number was greater than the threshold value, to delete the portion relating to the first slot from the event state number. The decoding process may be continued for further slots of the frame in a similar manner.

In an embodiment, a discrete number P of positions $p_k$ on a range of [0 . . . N−1] is encoded, such that the positions are not overlapping $p_k \neq p_h$ for $k \neq h$. Here, each unique combination of positions on the given range is called a state and each possible position in that range is called a slot. According to an embodiment of an apparatus for decoding, the first slot in the range is considered. If the slot does not have a position assigned to it, then the range can be reduced to N−1, and the number of possible states reduces to $$\binom{N-1}{P}.$$

Conversely, if the state is larger than $$\binom{N-1}{P},$$

then it can be concluded that the first slot has a position assigned to it. The following decoding algorithm may result from this:

For each slot h

If state > $\binom{N-h-1}{P}$ then

Assign a position to slot h

-continued

Update remaining state state := state − $\binom{N-h-1}{P}$

Reduce number of positions left P := P − 1

End

End

Calculation of the binomial coefficient on each iteration would be costly. Therefore, according to embodiments, the following rules may be used to update the binomial coefficient using the value from the previous iteration:

$$\binom{N}{P} = \binom{N-1}{P} \cdot \frac{N}{N-P} \text{ and } \binom{N}{P} = \binom{N}{P-1} \cdot \frac{N-P+1}{P}$$

Using these formulas, each update of the binomial coefficient costs only one multiplication and one division, whereas explicit evaluation would cost P multiplications and divisions on each iteration.

In this embodiment, the total complexity of the decoder is P multiplications and divisions for initialization of the binomial coefficient, for each iteration 1 multiplication, division and if-statement, and for each coded position 1 multiplication, addition and division. Note that in theory, it would be possible to reduce the number of divisions needed for initialization to one. In practice, however, this approach would result in very large integers, which are difficult to handle. The worst case complexity of the decoder is then N+2P divisions and N+2P multiplications, P additions (can be ignored if MAC-operations are used), and N if-statements.

In an embodiment, the encoding algorithm employed by an apparatus for encoding does not have to iterate through all slots, but only those that have a position assigned to them. Therefore, For each position $p_h$, $h = 1 \ldots P$ Update state state := state + $\binom{p_h - 1}{h}$ The encoder worst case complexity is P·(P−1) multiplications and P·(P−1) divisions, as well as P−1 additions.

Figure 10:
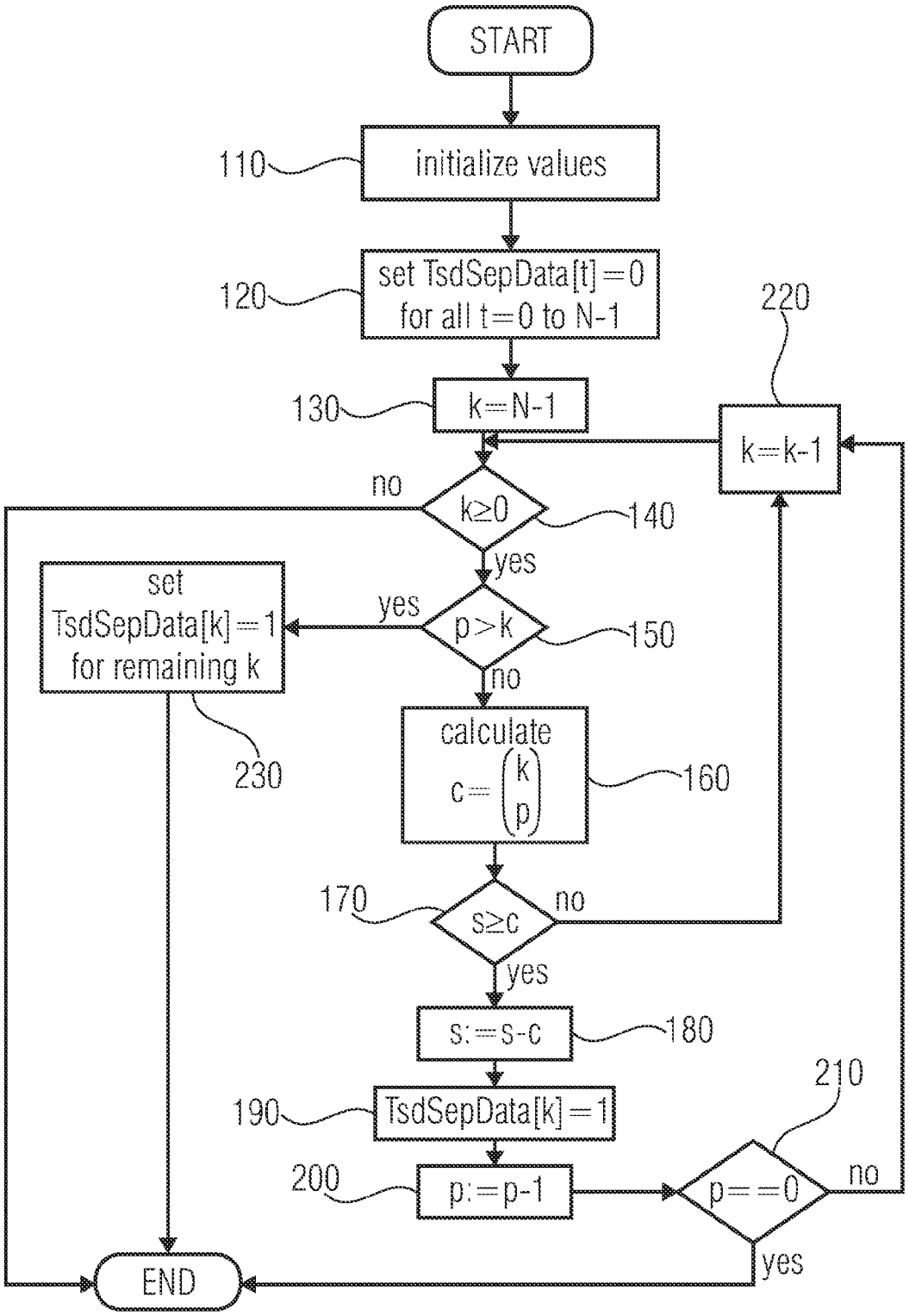
FIG. 10 is a flowchart illustrating a decoding process conducted by an apparatus for decoding according to an embodiment of the present invention.

FIG. 10 illustrates a decoding process conducted by an apparatus for decoding according to an embodiment of the present invention. In this embodiment, decoding is performed on a slot-by-slot basis.

In step 110, values are initialized. The apparatus for decoding stores the event state number, which it received as an input value, in variable s. Furthermore, the number of slots comprising events of the frame as indicated by an event slots number is stored in variable p. Moreover the total number of slots contained in the frame as indicated by a frame slots number is stored in variable N.

In step 120, the value of TsdSepData[t] is initialized with 0 for all slots of the frame. The bit array TsdSepData is the output data to be generated. It indicates for each slot position t, whether the slot with the corresponding slot position comprises an event (TsdSepData[t]=1) or whether it does not (TsdSepData[t]=0). In step 120 the corresponding values of all slots of the frame are initialized with 0.

In step 130 variable k is initialized with the value N−1. In this embodiment, the slots of a frame comprising N elements are numbered 0, 1, 2, . . . , N−1. Setting k=N−1 means that the slot with the highest slot number is regarded first.

In step 140, it is considered whether k≥0. If k<0, the decoding of the slot positions has been finished and the process terminates, otherwise the process continues with step 150.

In step 150, it is tested whether p>k. If p is greater than k, this means that all remaining slots comprise an event. The process continues at step 230 wherein all TsdSepData field values of the remaining slots 0, 1, . . . , k are set to 1 indicating that each of the remaining slots comprise an event. In this case, the process terminates afterwards. However, if step 150 finds that p is not greater than k, the decoding process continues in step 160.

In step 160, the value $$c = \binom{k}{p}$$

is calculated. c is used as threshold value.

In step 170, it is tested, whether the (eventually updated) event state number s is greater than or equal to c, wherein c is the threshold value just calculated in step 160.

If s is smaller than c, this means that the considered slot (with slot position k) does not comprise an event. In this case, no further action has to be taken, as TsdSepData[k] has already been set to 0 for this slot in step 140. The process then continues with step 220. In step 220, k is set to be k:=k−1 and the next slot is regarded.

However, if the test in step 170 shows that s is greater than or equal to c, this means that the considered slot k comprises an event. In this case, the event state number s is updated and is set to the value s:=s−c in step 180. Furthermore, TsdSepData[k] is set to 1 in step 190 to indicate that slot k comprises an event. Moreover, in step 200, p is set to p−1, indicating that the remaining slots to be examined now only comprise p−1 slots with events.

In step 210, it is tested whether p is equal to 0. If p is equal to 0, the remaining slots do not comprise events and the decoding process finishes. Otherwise, at least one of the remaining slots comprises an event and the process continues in step 220 where the decoding process continues with the next slot (k−1).

The decoding process of the embodiment illustrated in FIG. 10 generates the array TsdSepData as output value indicating for each slot k of the frame, whether the slot comprises an event (TsdSepData[k]=1) or whether it doesn't (TsdSepData[k]=0).

Returning to FIG. 9*c*, an apparatus for decoding 60 of an embodiment, wherein the apparatus implements the decoding process illustrated in FIG. 10 comprises a slot selector 90, which decides, which slots to consider. With respect to FIG. 10, such a slot selector would be adapted to execute process steps 130 and 220 of FIG. 10. A suitable analysing unit 70 of this embodiment would be adapted to execute processing steps 140, 150, 170, and 210 of FIG. 10. The generating unit 80 of such an embodiment would be adapted to conduct all other processing steps of FIG. 10.

FIG. 11 illustrates a pseudo code implementing the decoding of the positions of slots comprising events according to an embodiment of the present invention.

Figure 12:
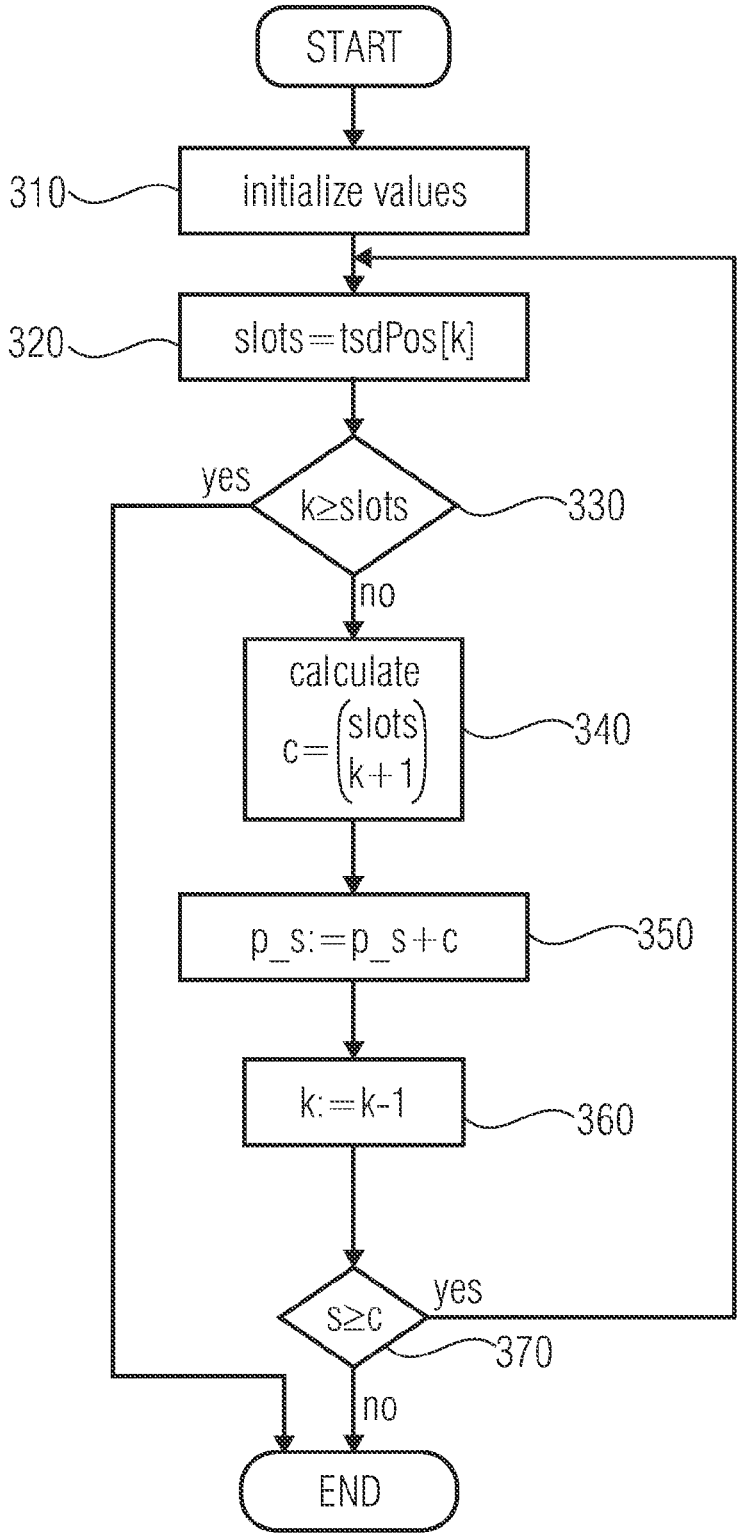
FIG. 12 is a flow chart illustrating an encoding process conducted by an apparatus for encoding according to an embodiment of the present invention.

FIG. 12 illustrates an encoding process conducted by an apparatus for encoding according to an embodiment of the present invention. In this embodiment, encoding is performed on a slot-by-slot basis. The purpose of the encoding process according to the embodiment illustrated in FIG. 12 is to generate an event state number.

In step 310, values are initialized. p_s is initialized with 0. The event state number is generated by successively updating variable p_s. When the encoding process is finished, p_s will carry the event state number. Step 310 also initializes variable k by setting k to k:=number of slots comprising events in a frame−1.

In step 320, variable "slots" is set to slots:=tsdPos[k], wherein tsdPos is an array holding the positions of slots comprising events. The slot positions in the array are stored in ascending order.

In step 330, a test is conducted, testing whether k≥slots. If this is the case, the process terminates. Otherwise, the process is continued in step 340.

In step 340, the value $$c = \binom{\text{slots}}{k+1}$$

is calculated.

In step 350, variable p_s is updated and set to p_s:=p_s+c.

In step 360, k is set to k:=k−1.

Then, in step 370, a test is conducted, testing whether k≥0. In this case, the next slot k−1 is regarded. Otherwise, the process terminates.

Figures 13, 14:
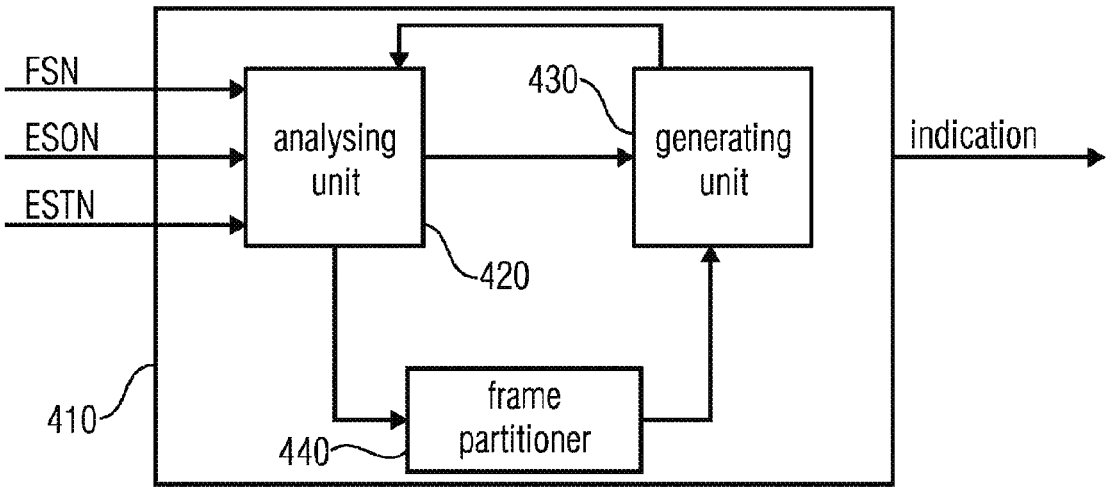
FIG. 13 is a pseudo code depicting a process of encoding positions of slots comprising events in an audio signal frame according to a further embodiment of the invention.
FIG. 14 illustrates an apparatus for decoding positions of slots comprising events in an audio signal frame according to a further embodiment of the present invention.

FIG. 13 depicts pseudo code, implementing the encoding of positions of slots comprising events according to an embodiment of the present invention.

FIG. 14 illustrates an apparatus for decoding 410 positions of slots comprising events in an audio signal frame according to a further embodiment of the present invention. Again, as in FIG. 9*a*, a frame slots number FSN, indicating the total number of slots of an audio signal frame, an event slots number ESON indicating the number of slots comprising events of the audio signal frame, and an event state number ESTN are fed into the apparatus for decoding 410. The apparatus for decoding 410 differs from the apparatus of FIG. 9*a* in that it further comprises a frame partitioner 440. The frame partitioner 440 is adapted to split the frame into a first frame partition comprising a first set of slots of the frame and into a second frame partition comprising a second set of slots of the frame, and wherein the slot positions comprising events are determined separately for each of the frame partitions. By this, the positions of slots comprising events may be determined by repeatedly splitting a frame or frame partitions in even smaller frame partitions.

The "partition based" decoding of the apparatus for decoding 410 of this embodiment is based on the following concepts, which may be applied for embodiments of an apparatus for decoding, an apparatus for encoding, a method for decoding and a method for encoding positions of slots which comprise events in an audio signal frame. The following concepts are also applicable for respective computer programs and encoded signals:

Partition based decoding is based on the idea that a frame is split into two frame partitions A and B, each frame partition comprising a set of slots, wherein frame partition A comprises $N_a$ slots and wherein frame partition B comprises $N_b$ slots and such that $N_a+N_b=N$. The frame can be arbitrarily split into two partitions, advantageously such that partition A and B have nearly the same total number of slots (e.g., such that $N_a=N_b$ or $N_a=N_b-1$). By splitting the frame into two partitions, the task of determining the slot positions where events have occurred is also split into two subtasks, namely determining the slot positions where events have occurred in frame partition A and determining the slot positions where events have occurred in frame partition B.

In this embodiment, it is again assumed that the apparatus for decoding is aware of the number of slots of the frame, the number of slots comprising events of the frame and an event state number. To solve both subtasks, the apparatus for decoding should also be aware of the number of slots of each frame partition, the number of slots where events occurred regarding each frame partition and the event state number of each frame partition (such an event state number of a frame partition is now referred to as "event substate number").

As the apparatus for decoding itself splits the frame into two frame partitions, it per se knows that frame partition A comprises $N_a$ slots and frame partition B comprises $N_b$ slots. Determining the number of slots comprising events for each one of both frame partitions is based on the following findings:

As the frame has been split into two partitions, each of the slots comprising events is now located either in partition A or in partition B. Furthermore, assuming that P is the number of slots comprising events of a frame partition, and N is the total number of slots of the frame partition and that f(P,N) is a function that returns the number of different combinations of slot positions of events of a frame partition, then the number of different combinations of slot positions of events of the whole frame (which has been split into partition A and partition B) is:

| Number of slots comprising events in partition A | Number of slots comprising events in partition B | Number of different combinations in the whole audio signal frame with this configuration |
|---|---|---|
| 0 | P | $f(0, N_a) \cdot f(P, N_b)$ |
| 1 | P-1 | $f(1, N_a) \cdot f(P-1, N_b)$ |
| 2 | P-2 | $f(2, N_a) \cdot f(P-2, N_b)$ |
| . . . | . . . | . . . |
| P | 0 | $f(P, N_a) \cdot f(0, N_b)$ |

Based on the above considerations, according to an embodiment all combinations with the first configuration, where partition A has 0 slots comprising events and where partition B has P slots comprising events, should be encoded with an event state number smaller than a first threshold value. The event state number may be encoded as an integer value being positive or 0. As there are only $f(0,N_a)\cdot f(P,N_b)$ combinations with the first configuration, a suitable first threshold value may be $f(0,N_a)\cdot f(P,N_b)$.

All combinations with the second configuration, where partition A has 1 slot comprising events and where partition B has P−1 slots comprising events, should be encoded with an event state number greater than or equal to the first threshold value, but smaller than or equal to a second value. As there are only $f(1,N_a)\cdot f(P-1,N_b)$ combinations with the second configuration, a suitable second value may be $f(0,N_a)\cdot f(P,N_b)+f(1,N_a)\cdot f(P-1,N_b)$. The event state number for combinations with other configurations is determined similarly.

According to an embodiment, decoding is performed by separating a frame into two frame partitions A and B. Then, it is tested whether an event state number is smaller than a first threshold value. In one embodiment, the first threshold value may be $f(0,N_a)\cdot f(P,N_b)$.

If the event state number is smaller than the first threshold value, it can then be concluded that partition A comprises 0 slots comprising events and partition B comprises all P slots of the frame where events occurred. Decoding is then conducted for both partitions with the respectively determined number representing the number of slots comprising events of the corresponding partition. Furthermore a first event state number is determined for partition A and a second event state number is determined for partition B which are respectively used as new event state number. Within this document, an event state number of a frame partition is referred to as an "event substate number".

However, if the event state number is greater than or equal to the first threshold value, the event state number may be updated. In an embodiment, the event state number may be updated by subtracting a value from the event state number, advantageously by subtracting the first threshold value, e.g. $f(0,N_a)\cdot f(P,N_b)$. In a next step, it is tested, whether the updated event state number is smaller than a second threshold value. In an embodiment, the second threshold value may be $f(1,N_a)\cdot f(P-1,N_b)$. If event state number is smaller than the second threshold value, it can be derived that partition A has 1 slot comprising events and partition B has P−1 slots comprising events. Decoding is then conducted for both partitions with the respectively determined numbers of slots comprising events of each partition. A first event substate value is employed for the decoding of partition A and a second event substate value is employed for the decoding of partition B. However, if the event state number is greater than or equal to the second threshold value, the event state number may be updated. In an embodiment, the event state number may be updated by subtracting a value from the event state number, advantageously $f(1,N_a)\cdot f(P-1,N_b)$. The decoding process is similarly applied for the remaining distribution possibilities of the slots comprising events regarding the two frame partitions.

In an embodiment, an event substate value for partition A and an event substate value for partition B may be employed for decoding of partition A and partition B, wherein both event substate values are determined by conducting the division:

$$\text{event state value}/f(\text{number of slots comprising events of partition } B, N_b)$$

Advantageously, the event substate number of partition A is the integer part of the above division and the event substate number of partition B is the reminder of that division. The event state number employed in this division may be the original event state number of the frame or an updated event state number, e.g. updated by subtracting one or more threshold values, as described above.

To illustrate the above described concept of partition based decoding, a situation is considered where a frame has two slots comprising events. Furthermore, if f(p,N) is again the function that returns the number of different combinations of slot positions of events of a frame partition, wherein p is the number of slots comprising events of a frame partition and N is the total number of slots of that frame partition. Then, for each of the possible distributions of the positions, the following number of possible combinations results:

| Positions in partition A | Position in partition B | Number of combinations in this configuration |
|---|---|---|
| 0 | 2 | $f(0, N_a) \cdot f(2, N_b)$ |
| 1 | 1 | $f(1, N_a) \cdot f(1, N_b)$ |
| 2 | 0 | $f(2, N_a) \cdot f(0, N_b)$ |

It can thus be concluded that if the encoded event state number of the frame is smaller than $f(0,N_a)\cdot f(2,N_b)$, then the slots comprising events must be distributed as 0 and 2. Otherwise, $f(0,N_a)\cdot f(2,N_b)$ is subtracted from the event state number and the result is compared with $f(1,N_a)\cdot f(1,N_b)$. If it is smaller, then positions are distributed as 1 and 1. Otherwise, we have only the distribution 2 and 0 left, and the positions are distributed as 2 and 0.

In the following, a pseudo code is provided according to an embodiment for decoding positions of slots comprising certain events (here: "pulses") in an audio signal frame. In this pseudo code, "pulses_a" is the (assumed) number of slots comprising events in partition A and "pulses_b" is the (assumed) number of slots comprising events in partition B. In this pseudo code, the (eventually updated) event state number is referred to as "state". The event substate numbers of partitions A and B are still jointly encoded in the "state" variable. According to a joint coding scheme of an embodiment, the event substate number of A (herein referred to as "state_a") is the integer part of the division state/f(pulses_b, $N_b$) and the event substate number of B (herein referred to as "state_b") is the reminder of that division. By this, the length (total number of slots of the partition) and the number of encoded positions (number of slots comprising events in the partition) of both partitions can be decoded by the same approach:

```
Function x = decodestate(state, pulses, N)
    1. Split vector into two partitions of length Na and Nb.
    2. For pulses_a from 0 to pulses
            a. pulses_b = pulses - pulses_a
            b. if state < f(pulses_a,Na)*f(pulses_b,Nb) then
                break for-loop.
            c. state := state - f(pulses_a,Na)*f(pulses_b,Nb)
    3. Number of possible states for partition B is
        no_states_b = f(pulses_b,Nb)
    4. The states, state_a and state_b, of partitions A and
        B, respectively, are the integer part and the
        reminder of the division state/no_states_b.
    5. If Na > 1 then the decoded vector of partition A is
        obtained recursively by
            xa = decodestate(state_a,pulses_a,Na)
        Otherwise (Na==1), and the vector xa is a scalar
        and we can set xa=state_a.
    6. If Nb > 1 then the decoded vector of partition B is
        obtained recursively by
            xb = decodestate(state_b,pulses_b,Nb)
        Otherwise (Nb==1), and the vector xb is a scalar and
        we can set xb=state_b.
    7. The final output x is obtained by merging xa and xb
        by x = [xa xb].
```

The output of this algorithm is a vector that has a one (1) at every encoded position (i.e. a slot position of a slot comprising an event) and zero (0) elsewhere (i.e. at positions of slots which do not comprise events).

In the following, a pseudo code is provided according to an embodiment for encoding positions of slots comprising events in an audio signal frame which uses similar variable names with a similar meaning as above:

```
Function state = encodestate(x,N)
    1. Split vector into two partitions xa and xb of length
        Na and Nb.
    2. Count pulses in partitions A and B in pulses_a and
        pulses_b, and set pulses=pulses_a+pulses_b.
    3. Set state to 0
    4. For k from 0 to pulses_a-1
            a. state := state + f(k,Na)*f(pulses-k,Nb)
    5. If Na > 1, encode partition A by
                state_a = encodestate(xa, Na);
            Otherwise (Na==1), set state_a = xa.
    6. If Nb > 1, encode partition B by
                state_b = encodestate(xb,Nb);
            Otherwise (Nb==1), set state_b = xb.
    7. Encode states jointly
            state := state + state_a*f(pulses_b,Nb) + state_b.
```

Here, it is assumed that, similarly to the decoder algorithm, every encoded position (i.e., a slot position of a slot comprising an event) is identified by a one (1) in vector x and all other elements are zero (0) (i.e., at positions of slots which do not comprise events).

The above recursive methods formulated in pseudo code can readily be implemented in a non-recursive way using standard methods.

According to an embodiment of the present invention, function f(p,N) may be realized as a look-up table. When the positions are non-overlapping, such as in the current context, then the number-of-states function f(p,N) is simply the binomial function which can be calculated on-line. There is $$f(p, N) = \frac{N(N-1)(N-2)\ \dots\ (N-k)}{k(k-1)(k-2)\ \dots\ 1}.$$

According to an embodiment of the present invention, both the encoder and the decoder have a for-loop where the product f(p−k,Na)*f(k,Nb) is calculated for consecutive values of k. For efficient computation, this can be written as $$\begin{aligned} f(p-k, N_a)f(k, N_b) &= \frac{N_a(N_a-1)(N_a-2)\ \dots\ (N_a-p+k)}{(p-k)(p-k-1)(p-k-2)\ \dots\ 1} \cdot \\ &\quad \frac{N_b(N_b-1)(N_b-2)\ \dots\ (N_b-k)}{k(k-1)(k-2)\ \dots\ 1} \\ &= \frac{N_a(N_a-1)(N_a-2)\ \dots\ (N_a-p-k+1)}{(p-k+1)(p-k)(p-k-1)\ \dots\ 1} \cdot \\ &\quad \frac{N_b(N_b-1)(N_b-2)\ \dots\ (N_b-k+1)}{(k-1)(k-2)\ \dots\ 1} \cdot \\ &\quad \frac{p-k+1}{N_a-p-k+1} \cdot \frac{N_a-k}{k} \\ &= f(p-k+1, N_a)f(k-1, N_b) \cdot \\ &\quad \frac{p-k+1}{N_a-p-k+1} \cdot \frac{N_a-k}{k}. \end{aligned}$$

In other words, successive terms for subtraction/addition (in step 2b and 2c in the decoder, and in step 4a in the encoder) can be calculated by three multiplications and one division per iteration.

Similarly as in the method described before, the state of a long vector (a frame with many slots) may be a very big integer number, easily extending the length of representation in standard processors. Therefore it will be necessitated to use arithmetic functions capable of handling very long integers.

Regarding complexity, the method regarded here is, in difference to the slot-by-slot processes above, a split and conquer-type algorithm. Assuming the input vector length is a power of two, then the recursion has a depth of log 2(N).

Since the number of pulses remains constant on each depth of the recursion, then the number of iterations of the for-loop is the same at each recursion. It follows that the number of loops is pulses·log 2(N).

As explained above, each update of the f(p−k,Na)·f(k,Nb) can be done with three multiplications and one division.

It should be noted that subtractions and comparisons in the decoder can be assumed to be one operation.

It can be readily seen that partitions are merged log 2(N)−1 times. In the joint encoding of states in the encoder, it is thus necessitated to multiply and add log 2(N)−1 times. Similarly, at the joint decoding of states in the decoder, it is necessitated to divide log 2(N)−1 times.

It should be noted that of the divisions, only the joint encoding of states in the decoder needs divisions where the denominator is a long integer. The other divisions have relatively short integers in the denominator. Since divisions with long denominators are the most complex operations, those should be avoided when possible.

In summary, the number of long integer arithmetic operations is in the decoder

| | |
|---|---|
| Multiplications | (3 · pulses + 1 ) · log2(N) − 1 |
| Divisions | (pulses + 1 ) · log2(N) − 1 |
| Of which long denominator divisions log2(N) − 1 | |
| Additions and subtractions | pulses · log2(N) |
| Similarly, in the encoder there are | |
| Multiplications | (3 · pulses + 1 ) · log2(N) − 1 |
| Divisions | (pulses + 1 ) · log2(N) − 1 |
| Of which long denominator divisions0 | |
| Additions and subtractions | (pulses + 2) · log2(N) |

Only log2(N) − 1 divisions with a long denominator are necessitated.

Figures 15, 16:
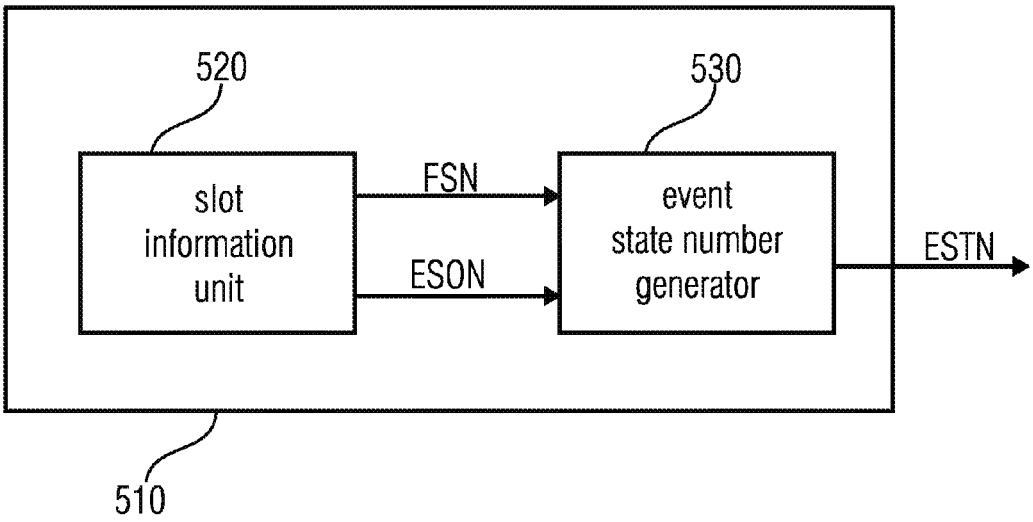
FIG. 15 illustrates an apparatus for encoding positions of slots comprising events in an audio signal frame according to a an embodiment of the present invention.
FIG. 16 depicts the syntax of MPS 212 Data of USAC according to an embodiment.

In further embodiments, above-described embodiments which comprise or which are adapted to employ recursive processing steps are modified such that some or all of the recursive processing steps are implemented in a non-recursive way using standard methods FIG. 15 illustrates an apparatus for encoding (510) positions of slots comprising events in an audio signal frame according to an embodiment. The apparatus for encoding (510) comprises an event state number generator (530) which is adapted to encode the positions of slots by encoding an event state number. Furthermore the apparatus comprises a slot information unit (520) adapted to provide a frame slots number and an event slots number to the event state number generator (530). The event state number generator may implement one of the above-described methods for encoding.

In a further embodiment, an encoded audio signal is provided. The encoded audio signal comprises an event state number. In another embodiment, the encoded audio signal furthermore comprises an event slots number. Moreover, the encoded audio signal frame may also comprise a frame slots number. In the audio signal frame, the positions of slots comprising events in an audio signal frame can be decoded according to one of the above-described methods for decoding. In an embodiment, the event state number, the event slots number and the frame slots number are transmitted such that the positions of slots comprising events in an audio signal frame can be decoded by employing one of the above-described methods.

The inventive encoded audio signal can be stored on a digital storage medium or a non-transitory storage medium or can be transmitted on a transmission medium such as a wireless transmission medium or a wired transmission medium such as the Internet.

The following explains USAC syntax definitions adapted to support a Transient Steering Decorrelator (TSD) according to an embodiment:

FIG. 16 illustrates MPS (MPEG Surround) 212 data. MPS 212 data is a block of data comprising payload for the MPS 212 stereo module. The MPS 212 data comprises TSD data.

FIG. 17 depicts the syntax of TSD data. It comprises the number of transient slots (bsTsdNumTrSlots) and TSD Transient Phase Data (bsTsdTrPhaseData) for the slots in an MPS 212 data frame. If a slot comprises transient data (TsdSepData[ts] is set to 1) bsTsdTrPhaseData comprises phase data, otherwise bsTsdTrPhaseData[ts] is set to 0.

nBitsTrSlots defines the number of bits employed for carrying the number of transient slots (bsTsdNumTrSlots). nBitsTrSlots depends on the number of slots in a MPS 212 data frame (numSlots). FIG. 18 illustrates the relationship of the number of slots in a MPS 212 data frame and the number of bits employed for carrying the number of transient slots.

FIG. 19 defines the meaning of tempShapeConfig. tempShapeConfig indicates the operation mode of temporal shaping (STP or GES) or the activation of transient steering decorrelation in the decoder. If tempShapeConfig is set to 0, temporal shaping is not applied at all; if tempShapeConfig is set to 1, Subband Domain Temporal Processing (STP) is applied; if tempShapeConfig is set to 2, Guided Envelope Shaping (GES) is applied; and if tempShapeConfig is set to 3 Transient Steering Decorrelation (TSD) is applied.

FIG. 20 illustrates the syntax of TempShapeData. If bsTempShapeConfig is set to 3, TempShapeData comprises bsTsdEnable indicating that TSD is enabled in a frame.

Figure 21:
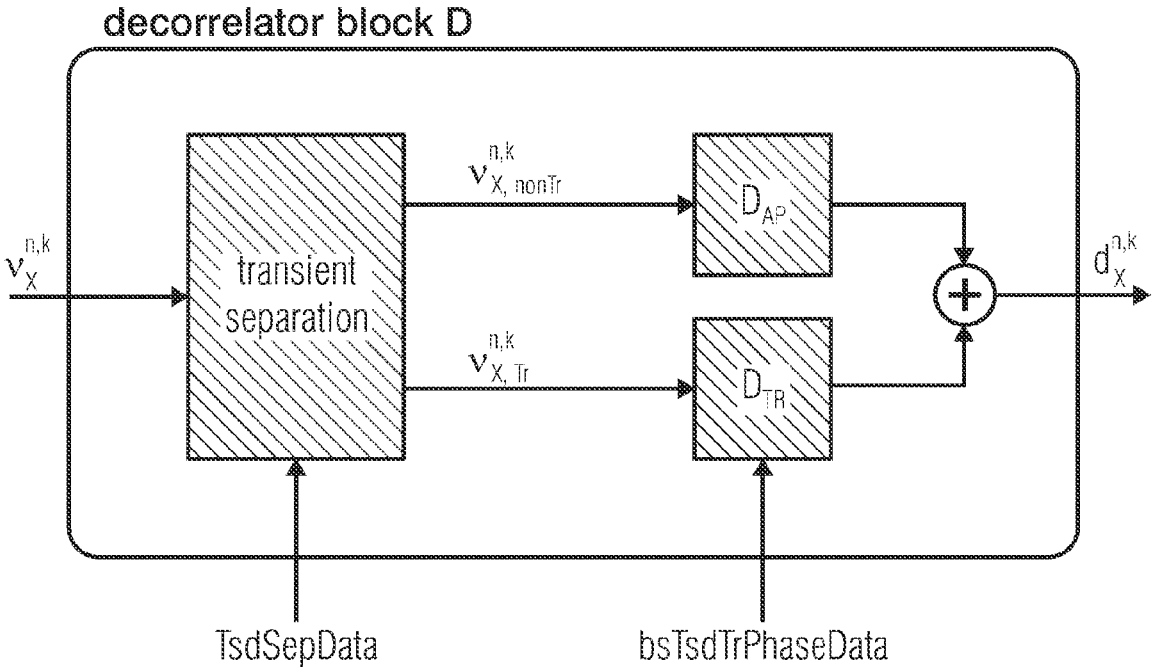
FIG. 21 illustrates a decorrelator block D in an OTT decoding block according to an embodiment.

FIG. 21 illustrates a decorrelator block D according to an embodiment. The decorrelator block D in the OTT decoding block comprises a signal separator, two decorrelator structures, and a signal combiner.

$D_{AP}$ means: all-pass decorrelator as defined in subsection 7.11.2.5 (All-Pass Decorrelator).

$D_{TR}$ means: Transient decorrelator.

If the TSD tool is active in the current frame, i.e. if (bsTsdEnable==1), the input signal is separated into a transient stream $v_{X,TRr}^{n,k}$ and a non-transient stream $v_{X,nonTr}^{n,k}$ according to:

$$v_{X,Tr}^{n,k} = \begin{cases} v_X^{n,k}, & \text{if } TsdSepData(n) = 1, 7 \le k \\ 0, & \text{otherwise} \end{cases}$$

$$v_{X,nonTr}^{n,k} = \begin{cases} 0, & \text{if } TsdSepData(n) = 1, 7 \le k \\ v_X^{n,k}, & \text{otherwise} \end{cases}$$

The per-slot transient separation flag TsdSepData(n) is decoded from the variable length code word bsTsdCodedPos by TsdTrPos_dec( ) as described below. The code word length of bsTsdCodedPos, i.e. nBitsTsdCW, is calculated according to:

$$nBitsTsdCW = \text{ceil}\left(\log_2\left(\begin{matrix} bsFrameLength \\ bsTsdNumTrSlots + 1 \end{matrix}\right)\right)$$

Returning to FIG. 11, FIG. 11 illustrates the decoding of the TSD transient slot separation data bsTsdCodedPos into TsdSepData[n] according to an embodiment. An array of length numSlots consisting of for coded transient positions and '0's else, is defined as illustrated in FIG. 11.

If the TSD tool is disabled in the current frame, i.e. if (bsTsdEnable==0), the input signal is processed as if TsdSepData(n)=0 for all n.

Transient signal components are processed in a transient decorrelator structure $D_{TR}$ as follows:

$$d_{X,Tr}^{n,k} = \begin{cases} e^{j\varphi_{TSD}^{n}} \cdot v_{X,Tr}^{n,k}, & \text{if } bsTsdEnable = 1 \\ 0, & \text{otherwise,} \end{cases}$$

where $$\varphi_{TSD}^{n} = \pi \cdot 0.25 \cdot bsTsdTrPhaseData(n).$$

The non-transient signal components are processed in all-pass decorrelator $D_{AP}$ as defined in the next subsection, yielding the decorrelator output for non-transient signal components, $$d_{X,nonTr}^{n,k} = D_{AP}\{v_{X,nonTr}^{n,k}\}.$$

The decorrelator outputs are added to form the decorrelated signal containing both transient and non-transient components, $$d_{X}^{n,k} = d_{X,Tr}^{n,k} + d_{X,nonTr}^{n,k}.$$

FIG. 22 illustrates the syntax of EcData comprising bsFrequencyResStrideXXX. The syntax element bsFreqResStride allows for utilization of broadband cues in MPS. XXX is to be replaced by the value of the data type (CLD, ICC, IPD).

The Transient Steering Decorrelator in the OTT decoder structure provides the possibility to apply a specialized decorrelator to transient components of applause-like signals. The activation of this TSD feature is controlled by the encoder generated bsTsdEnable flag that is transmitted once per frame.

TSD data in the two channels to one channel module (R-OTT) of the encoder is generated as follows:

- Run a semantic signal classifier that detects applause-like signals. The classification result is transmitted once per frame: The bsTsdEnable flag is set to 1 for applause-like signals, otherwise it is set to 0.
- if bsTsdEnable is set to 0 for the current frame, no further TSD data is generated/transmitted for this frame.
- if bsTsdEnable is set to 1 for current frame, perform the following:
  - Switch on the broadband calculation of the OTT spatial parameters.
  - Detect transients in the current frame (binary decision per MPS time slot).
  - Encode the tsdPosLen transient slot positions in a vector tsdPos according to the following pseudocode, where the slot positions in tsdPos are expected in ascending order. FIG. 13 illustrates a pseudocode for encoding transient slot positions in tsdPosLen.
  - Transmit the number of transient slots (bsTsdNumTrSlots=(number of detected transient slots)−1).
  - Transmit the encoded transient positions (bsTsdCodedPos).
  - For each transient slot calculate a phase measure that represents the broadband phase difference between the downmix signal and the residual signal.
  - For each transient slot encode and transmit the broadband phase difference measure (bsTsdTrPhaseData).

Figure 23:
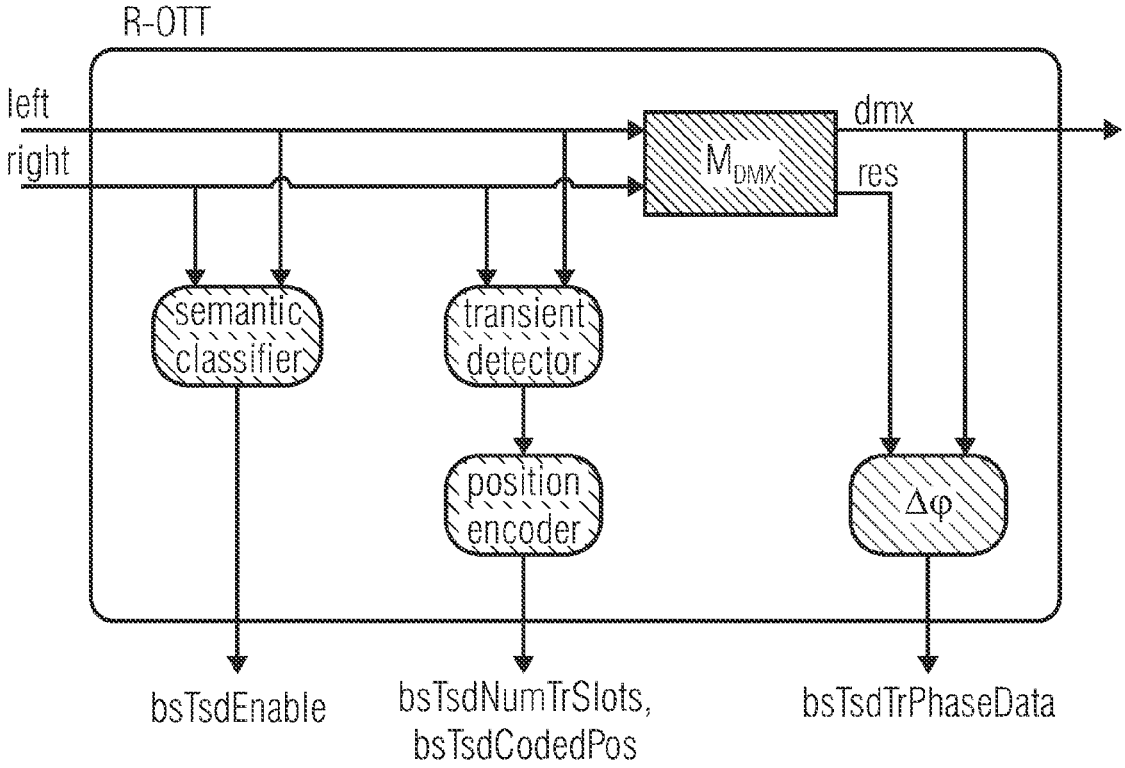
FIG. 23 illustrates a signal flow chart for the generation of TSD data.

Finally, FIG. 23 illustrates a signal flow chart for the generation of TSD data in the two channels to one channel module (R-OTT).

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] J. Breebaart, S. van de Par, A. Kohlrausch, E. Schuijers, "High-Quality Parametric Spatial Audio Coding at Low Bitrates" in Proceedings of the AES 116$^{th}$ Convention, Berlin, Preprint 6072, May 2004

[2] J. Herre, K. Kjörling, J. Breebaart et al., "MPEG surround—the ISO/MPEG standard for efficient and compatible multi-channel audio coding," in Proceedings of the 122$^{th}$ AES Convention, Vienna, Austria, May 2007

[3] Pulkki, Ville; "Spatial Sound Reproduction with Directional Audio Coding" in J. Audio Eng. Soc., Vol. 55, No. 6, 2007

[4] ISO/IEC International Standard "Information Technology—MPEG audio technologies—Part1: MPEG Surround", ISO/IEC 23003-1:2007.

[5] J. Engdegard, H. Purnhagen, J. Röden, L. Liljeryd, "Synthetic Ambience in Parametric Stereo Coding" in Proceedings of the AES 116$^{th}$ Convention, Berlin, Preprint, May 2004

The invention claimed is:

1. An audio decoder for decoding an encoded audio signal comprising an audio signal frame comprising slots and events associated with the slots, comprising:

an analysing unit for adapted to analyse a frame slots number indicating the total number of slots of the audio signal frame, an event slots number indicating the number of slots comprising the events of the audio signal frame, and an event state number;

a generating unit adapted to generate an indication of a plurality of positions of slots comprising the events in the audio signal frame using the frame slots number, the event slots number and the event state number; and an audio signal processor adapted to generate an audio output signal depending on the indication of a plurality of positions of slots comprising the events in the audio signal frame, using frame slots number, the event slots number and the event state number, wherein audio decoder comprises a hardware implementation.

2. The audio decoder according to claim 1, wherein the audio decoder is adapted to decode the slot positions of transients in an audio signal frame.

3. The audio decoder according to claim 1, wherein the analysing unit is adapted to conduct a test comparing the event state number or an updated event state number with a threshold value.

4. The audio decoder according to claim 3, wherein the analysing unit is adapted to conduct the test by comparing, whether the event state number or an updated event state number is greater than, greater than or equal to, smaller than, or smaller than or equal to the threshold value, and wherein the generating unit is furthermore adapted to update the event state number or an updated event state number depending on the result of the test.

5. The audio decoder according to claim 3, wherein the audio decoder furthermore comprises a slot selector, wherein the slot selector is adapted to select a slot as a considered slot, wherein the analysing unit is adapted to conduct the test with respect to a considered slot, and wherein the threshold value depends on the frame slots number, the event slots number and on the position of the considered slot within the frame.

6. The audio decoder according to claim 5, wherein the analysing unit is adapted to conduct the test comparing the event state number or an updated event state number with the threshold value, wherein the threshold value is $$\binom{N-h-1}{P},$$

wherein N is the total number of slots of the audio signal frame, wherein P is the number of slots comprising the events of the audio signal frame or of a considered portion of the audio signal frame and wherein h is the position of the considered slot within the frame.

7. The audio decoder according to claim 1, wherein the audio decoder further comprises a frame partitioner, wherein the frame partitioner is adapted to split the frame into a first frame partition comprising a first set of slots of the frame and into a second frame partition comprising a second set of slots of the frame, and wherein audio decoder is further adapted to determine the slot positions comprising the events for each of the frame partitions separately.

8. The audio decoder according to claim 1, wherein the audio signal processor is adapted to generate the audio output signal according to a first method, if the indication of a plurality of positions of slots comprising the events is in a first indication state, and wherein the audio signal processor is adapted to generate the audio output signal according to a different second method, if the indication of a plurality of positions of slots comprising the events is in a second indication state which is different from the first indication state.

9. The audio decoder according to claim 8, wherein the audio signal processor is adapted, such that the first method comprises employing a transient decorrelator for decoding a slot, if the first indication state indicates that the slot comprises a transient and wherein the second method comprises employing a second decorrelator for decoding a slot, if the second indication state indicates that the slot does not comprise a transient.

10. An audio encoder for generating an encoded audio signal, comprising:

an event state number generator adapted to encode positions of slots comprising events in an audio signal frame by encoding an event state number; and a slot information unit, being adapted to provide a frame slots number indicating the total number of slots of the audio signal frame and an event slots number indicating the number of slots comprising the events of the audio signal frame to the event state number generator;

wherein the event state number, the frame slots number and the event slots number together indicate a plurality of positions of slots comprising the events in the audio signal frame;

wherein the audio encoder is configured to generate the encoded audio signal comprising information on the event state number, the frame slots number and the event slots number; and wherein audio encoder comprises a hardware implementation.

11. The audio encoder according to claim 10, wherein the event state number generator is adapted to generate an event state number by adding a positive integer value for each slot comprising an event.

12. The audio encoder to claim 10, wherein the event state number generator is adapted to generate the event state number by determining a first event substate number for a first frame partition, by determining a second event substate number for a second frame partition, and by combining the first and the second event state number to generate the event state number.

13. A method for decoding an encoded audio signal comprising an audio signal frame comprising slots and events associated with the slots, comprising:

analysing a frame slots number indicating the total number of slots of the audio signal frame, an event slots number indicating the number of slots comprising the events of the audio signal frame, and an event state number; and generating an indication of a plurality of positions of slots comprising the events in the audio signal frame using frame slots number, the event slots number and the event state number;

generating an audio output signal depending on the indication of a plurality of positions of slots comprising the events in the audio signal frame; using frame slots number, the event slots number and the event state number, wherein the method is implemented using a hardware implementation.

14. A method for generating an encoded audio signal, comprising:

receiving or determining a frame slots number indicating the total number of slots of the audio signal frame;

receiving or determining an event slots number indicating the number of slots comprising events of an audio signal frame; and encoding the positions of slots by encoding an event state number;

wherein the event state number, the frame slots number and the event slots number together indicate a plurality of positions of slots comprising the events in the audio signal frame; and generating the encoded audio signal comprising information on the event state number, the frame slots number and the event slots number;

wherein the method is implemented using a hardware implementation.

15. A non-transitory computer-readable medium comprising a computer program for decoding an encoded audio signal implementing a method for decoding an encoded audio signal according to claim 13.

16. A non-transitory computer-readable medium comprising a computer program for generating an encoded audio signal implementing a method for generating an encoded audio signal according to claim 14.

17. A non-transitory computer-readable medium comprising an encoded audio signal comprising an event state number, wherein the positions of slots comprising events are decodable according to the method of claim 13.

* * * * *